US011452417B2

(12) United States Patent
Na et al.

(10) Patent No.: US 11,452,417 B2
(45) Date of Patent: Sep. 27, 2022

(54) ROBOT CLEANER STATION

(71) Applicant: Samsung Electronics Co., Ltd., Suwon-si (KR)

(72) Inventors: Woojin Na, Suwon-si (KR); Bosang Kim, Suwon-si (KR); Kyongsu Kim, Suwon-si (KR); Hakbong Lee, Suwon-si (KR); Jaeyoul Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 104 days.

(21) Appl. No.: 16/919,890

(22) Filed: Jul. 2, 2020

(65) Prior Publication Data

US 2021/0000315 A1 Jan. 7, 2021

(30) Foreign Application Priority Data

Jul. 2, 2019 (KR) ..... 10-2019-0079461

(51) Int. Cl.
*A47L 9/14* (2006.01)
*A47L 9/24* (2006.01)

(52) U.S. Cl.
CPC ..... *A47L 9/149* (2013.01); *A47L 9/244* (2013.01); *A47L 9/248* (2013.01); *A47L 2201/024* (2013.01)

(58) Field of Classification Search
None
See application file for complete search history.

(56) References Cited

U.S. PATENT DOCUMENTS 3,905,621 A * 9/1975 DeMarco ..... C03B 33/027 285/7
5,935,280 A * 8/1999 Lee ..... A47L 9/1427 55/378

(Continued)

FOREIGN PATENT DOCUMENTS

CN 108464775 8/2018
DE 102010016263 10/2011

(Continued)

OTHER PUBLICATIONS

International Search Report dated Oct. 27, 2020 in International Patent Application No. PCT/KR2020/008180.

(Continued)

*Primary Examiner* — Joseph J Hail
*Assistant Examiner* — Dana Lee Poon
(74) *Attorney, Agent, or Firm* — Staas & Halsey LLP

(57) ABSTRACT

A robot cleaner station includes a cleaner docking portion to which a robot cleaner is docked and including an suction port in communication with a dust collector of the robot cleaner when the robot clear is docked to the cleaner docking portion, a collector including a collection chamber in which dust sucked from the dust collector through the suction port is collected, and a station suction device configured to generate a suction force to suck the dust from the dust collector to the collection chamber, and a connector configured to connect the suction port to the collection chamber. The connector includes a guide portion in communication with the suction port, a suction tube provided in the collection chamber to allow the dust which is guided by the guide portion to be sucked to the collection chamber, and a connection hose configured to connect the guide portion to the suction tube.

17 Claims, 22 Drawing Sheets

(56) References Cited

U.S. PATENT DOCUMENTS

| | | | | |
|---|---|---|---|---|
| 6,094,775 | A * | 8/2000 | Behmer | A47L 5/225 15/329 |
| 6,115,881 | A * | 9/2000 | Hult | A47L 9/242 15/327.1 |
| 6,685,491 | B2 * | 2/2004 | Gergek | H01R 13/005 439/135 |
| 10,792,454 | B2 * | 10/2020 | Forrester | A61M 16/1095 |
| 2002/0092103 | A1 * | 7/2002 | Bruno | A47L 9/244 15/1 |
| 2009/0049640 | A1 | 2/2009 | Lee et al. | |
| 2014/0130272 | A1 | 5/2014 | Won et al. | |
| 2015/0223651 | A1 | 8/2015 | Kuhe et al. | |
| 2016/0374528 | A1 * | 12/2016 | Morin | A47L 9/2842 15/319 |
| 2018/0055314 | A1 * | 3/2018 | Rupp | A47L 9/242 |
| 2019/0133399 | A1 | 5/2019 | Morin et al. | |
| 2019/0290087 | A1 * | 9/2019 | Conrad | A47L 5/24 |

FOREIGN PATENT DOCUMENTS

| | | | |
|---|---|---|---|
| DE | 202016104066 | | 12/2017 |
| JP | 2003-52595 | | 2/2009 |
| KR | 10-0707354 | | 4/2007 |
| KR | 10-2007-0094288 | | 9/2007 |
| KR | 2007094288 | A * | 9/2007 |
| KR | 10-2007-0103248 | | 10/2007 |
| KR | 10-1330734 | | 11/2013 |

OTHER PUBLICATIONS

Extended European Search Report dated Nov. 17, 2020 in European Patent Application No. 20179856.8.

* cited by examiner

ROBOT CLEANER STATION

CROSS-REFERENCE TO RELATED APPLICATIONS

This application is based on and claims priority under 35 U.S.C. § 119 to Korean Patent Application No. 10-2019-0079461, filed on Jul. 2, 2019, in the Korean Intellectual Property Office, the disclosure of which is incorporated by reference herein in its entirety.

BACKGROUND

1. Field

The disclosure relates to a robot cleaner station capable of optimizing a suction flow path for suctioning dust sucked from a dust collector of a robot cleaner into a collection chamber.

2. Description of the Related Art

In general, a robot cleaner is a device for automatically cleaning a space, which is to be cleaned, by sucking dirt such as dust accumulated on the floor while traveling in the cleaning space, without a user's operation. The robot cleaner cleans the space to be cleaned while traveling in the space to be cleaned.

The robot cleaner identifies the distance to obstacles such as furniture, office supplies, and walls installed in a cleaning area through a distance sensor, and cleans the cleaning area while changing directions by selectively driving left and right wheel motors of the robot cleaner.

The robot cleaner may clean the floor through a cleaning pad equipped with a wet cloth or a dry cloth, or the robot cleaner may clean the floor using a dust collector.

Dust, which is collected in the dust collector included in the robot cleaner configured to clean the floor using the dust collector, may be emptied manually by a user or emptied automatically by a collector provided at a station.

The station may include a primary suction port for suctioning dust collected in the dust collector of the robot cleaner, and a secondary suction port for manually cleaning the surroundings of the station.

Because the suction power that the station can suck dust is limited and an area of an inlet of the secondary suction port is small, the secondary suction port may not suck large-size debris such as tissue and cut-paper.

In addition, in order to increase the area of the inlet of the secondary suction port, it is required to increase a volume of the station so as to generate high suction power. In addition, when the area of the inlet of the secondary suction port is large while the volume of the station is small, the suction force may be reduced and thus it may hard to suction even small size dust.

SUMMARY

Therefore, it is an aspect of the disclosure to provide a robot cleaner station capable of optimizing a suction flow path, through which dust is sucked, by forming a connection hose, which is configured to connect a guide portion to a collection chamber, with a flexible material, wherein the guide portion is configured to guide dust sucked from a dust collector of a robot cleaner and the collection chamber is configured to collect the dust guided from the guided portion.

It is another aspect of the disclosure to provide to a robot cleaner station capable of performing a cleaning function manually through a connection hose including opposite ends detachably fastened to a guide portion and a collection chamber, respectively.

Additional aspects of the disclosure will be set forth in part in the description which follows and, in part, will be obvious from the description, or may be learned by practice of the disclosure.

In accordance with an aspect of the disclosure, a robot cleaner station includes a cleaner docking portion to which a robot cleaner is docked and including an suction port in communication with a dust collector of the robot cleaner, a collector including a collection chamber in which the dust of the dust collector sucked through the suction port is collected, and a station suction device configured to generate a suction force to allow the dust of the dust collector to be sucked to the collection chamber, and a connector configured to connect the suction port to the collection chamber. The connector includes a guide portion in communication with the suction port and extended in a horizontal direction in the cleaner docking portion, a suction tube provided in the collection chamber to allow the dust of dust collector, which is guided to the guide portion, to be sucked to the collection chamber, and a connection hose configured to connect the guide portion to the suction tube, the connection hose including opposite ends detachably fastened to the guide portion and the suction tube, respectively, the connection hose formed of a material having flexibility.

The robot cleaner station may further include a station housing in which the collector is accommodated, and the connection hose may be accommodated in the station housing.

The connection hose may include a first fastener detachably fastened to the guide portion, a second fastener detachably fastened to the suction tube, and a suction flow path provided between the first fastener and the second fastener to allow the dust of the dust collector to be sucked therein.

The guide portion may include a communication opening in communication with the suction port, a first connection hose fastener to which the first fastener is detachably fastened, and a guide flow path provided between the communication opening and the first connection hose fastener so as to guide the dust of the dust collector.

The first fastener may include a plurality of first hooks detachably fastened to the first connection hose fastener, and a first sealing member configured to seal between the first fastener and the first connection hose fastener, and the first connection hose fastener may include a plurality of first hook fasteners to which the plurality of first hooks is detachably fastened.

The first fastener is detachably fastened to the first connection hose fastener such that when manually cleaning a floor, the first fastener may be separated from the first connection hose fastener and the floor is cleaned with the connection hose.

An accessory for manually cleaning the floor and an extension hose configured to increase a length of the connection hose may be detachably fastened to the first fastener.

The first fastener may include a protrusion to which a button holder configured to fasten the connection hose and the guide portion is detachably fastened, and the guide portion may include a communication opening in communication with the suction port, a button holder fastener to which the button holder is detachably fastened, and a guide flow path provided between the communication opening and the button holder fastener so as to guide the dust of the dust collector.

The button holder may include a fixing protrusion detachably fixed to the button holder fastener and a button including a hook detachably fastened to the protrusion, and the button holder fastener may include an insertion groove into which the fixing protrusion is inserted, and a fixing groove to which the fixing protrusion inserted into the insertion groove is rotated and fixed.

The collection chamber may include an insertion port into which the suction tube is inserted, and the suction tube may include an insertion portion inserted into the insertion port and a second connection hose fastener to which the second fastener is detachably fastened.

The second fastener may include a plurality of second hooks detachably fastened to the second connection hose fastener, and a second sealing member configured to seal between the second fastener and the second connection hose fastener, and the second connection hose fastener may include a plurality of second hook fasteners to which the plurality of second hooks is detachably fastened.

The second fastener may include a first screw detachably fastened to the second connection hose fastener, and a second sealing member configured to seal between the second fastener and the second connection hose fastener, and the second connection hose fastener may include a second screw to which the first screw is detachably fastened.

The collection chamber may include a dust bag accommodated in the collection chamber and in which the dust of the dust collector is collected, and the suction tube may be connected to the dust bag.

The first connection hose fastener may be extended at an angle of 90 degrees or more and 180 degrees or less with respect to the guide flow path.

The connection hose may be arranged on the outside of the station housing in which the collector is accommodated, and the guide portion may be extended from the inside of the cleaner docking portion to the outside of the station housing in a horizontal direction so as to be connected to the connection hose.

In accordance with an aspect of the disclosure, a robot cleaner station includes a cleaner docking portion to which a robot cleaner is docked and including an suction port in communication with a dust collector of the robot cleaner, a collection chamber including a dust bag in which dust of a dust collector sucked through the suction port is collected, a station suction device configured to generate a suction force to allow the dust of the dust collector to be sucked to the dust bag, and a connector configured to connect the suction port to the collection chamber. The connector includes a guide portion in communication with the suction port and extended in a horizontal direction in the cleaner docking portion, a suction tube provided in the collection chamber to allow the dust of dust collector, which is guided to the guide portion, to be sucked to the dust bag, and a connection hose formed of a material having flexibility so as to connect the guide portion to the suction tube, and configured to be detachably fastened to the guide portion, so as to be separated from the guide portion to suck dust on a floor for manual cleaning.

The connection hose may include a first fastener detachably fastened to the guide portion, a second fastener detachably fastened to the suction tube, and a suction flow path provided between the first fastener and the second fastener to allow the dust of the dust collector to be sucked therein.

When dust is caught in the suction flow path, the first fastener and the second fastener may be respectively separated from the guide portion and the suction tube to remove the dust caught in the suction flow path.

The collection chamber may include a bag fastener to which the dust bag is detachably fastened, and the dust bag may include a chamber fastener detachably fastened to the bag fastener.

The collection chamber may include an insertion port into which the suction tube is inserted, and the bag fastener and the chamber fastener may include a first opening and a second opening provided at a position corresponding to the insertion port so as to communicate with the insertion port.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
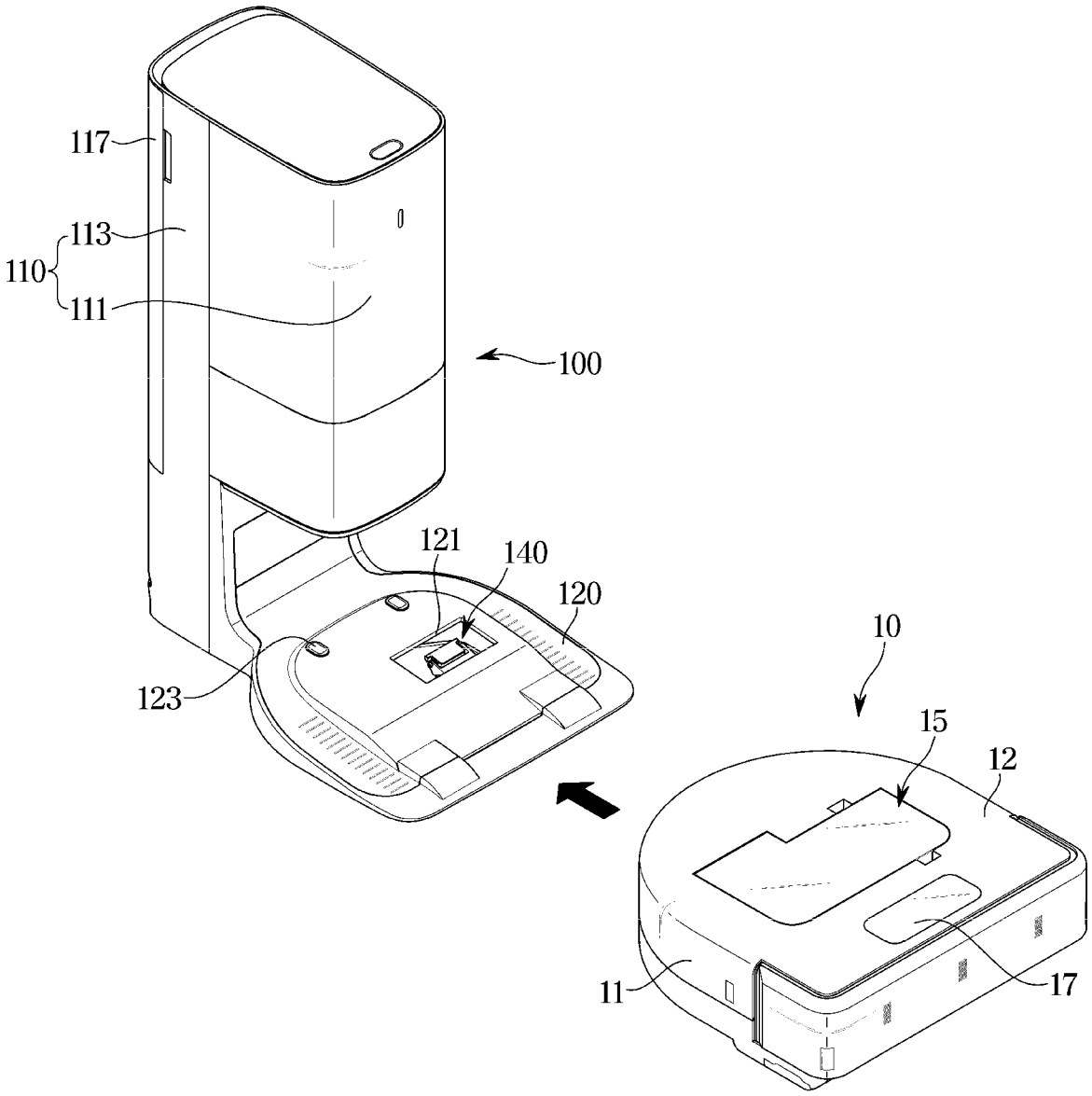
FIG. 1 is a view illustrating a state in which a robot cleaner is separated from a robot cleaner station according to an embodiment of the disclosure.

Embodiments described in the disclosure and configurations illustrated in the drawings are merely examples of the embodiments of the disclosure, and may be modified in various different ways at the time of filing of the present application to replace the embodiments and drawings of the disclosure.

In addition, the same reference numerals or signs illustrated in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "front", "rear", "forward", "rearward", "upper portion", "lower portion", "upper end", "lower end", "left side" and "right side" may be defined by the drawings, but the shape and the location of the component is not limited by the term.

Figure 2:
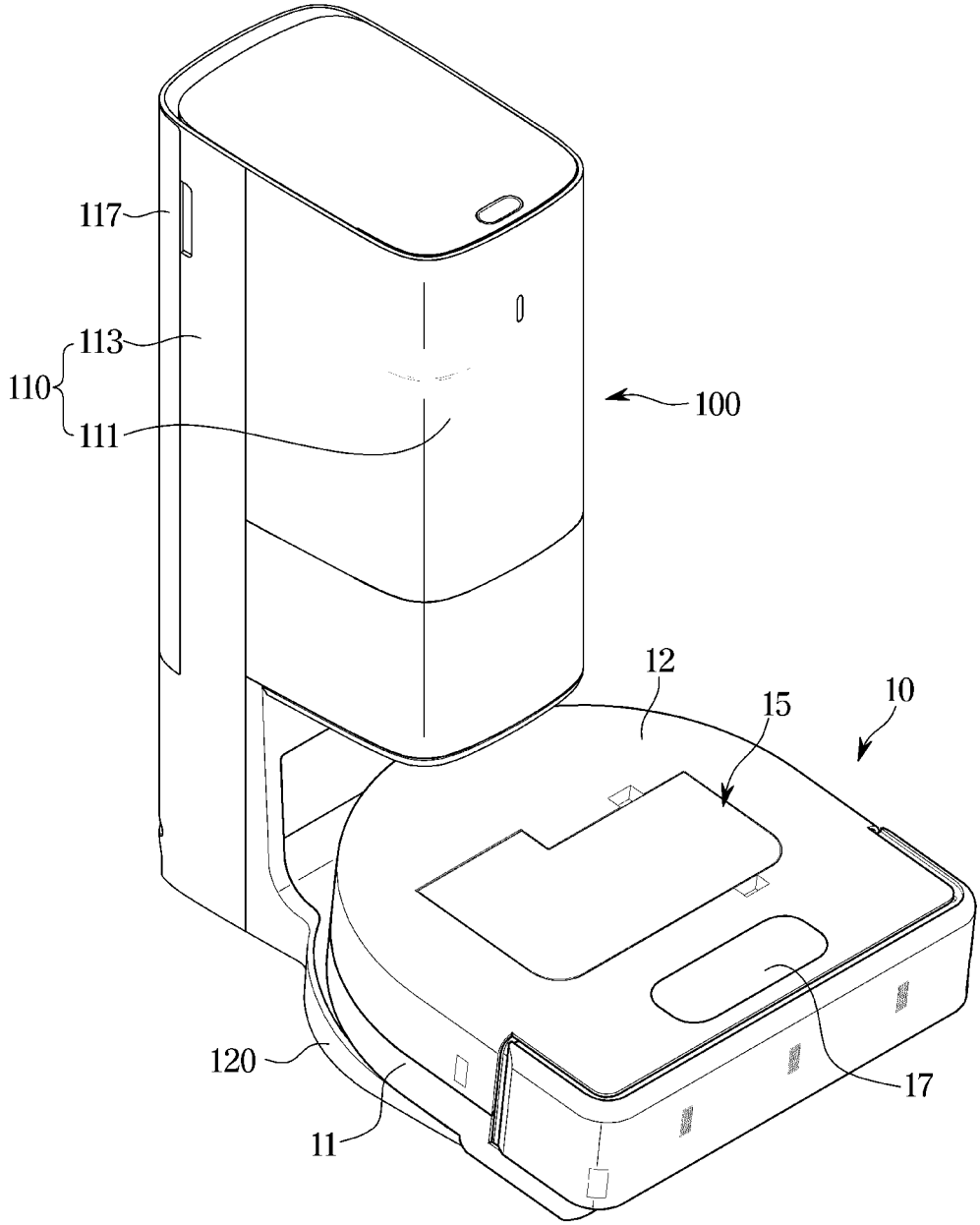
FIG. 2 is a view illustrating a state in which the robot cleaner of FIG. 1 is docked to the robot cleaner station.

The disclosure will be described more fully hereinafter with reference to the accompanying drawings FIG. 1 is a view illustrating a state in which a robot cleaner is separated from a robot cleaner station according to an embodiment of the disclosure and FIG. 2 is a view illustrating a state in which the robot cleaner of FIG. 1 is docked to the robot cleaner station.

As illustrated in FIGS. 1 and 2, a robot cleaner 10 may clean a floor while traveling along the floor. The floor cleaned by the robot cleaner 10 may be referred to as a surface to be cleaned. The robot cleaner 10 may travel to a station 100 when the robot cleaner 10 needs to charge. In addition, the robot cleaner 10 may travel to the station 100 when the robot cleaner 10 needs to empty dust inside a dust collection chamber 16 because the dust collection chamber 16 is fully filled with the dust.

The robot cleaner 10 may include a cleaner housing 11 in which a receiving space is formed, and a cleaner cover 12 configured to cover an open upper surface of the cleaner housing 11. Electronic components may be arranged in the cleaner housing 11. The cleaner cover 12 may be removably coupled to the cleaner housing 11.

A cleaner inlet 13 (refer to FIG. 4) may be formed in the cleaner housing 11. The cleaner inlet 13 may be formed toward the surface to be cleaned. The cleaner inlet 13 may be formed by passing through the bottom surface of the cleaner housing 11. Together with air, dust on the surface to be cleaned may be introduced into the dust collection chamber 16 of a dust collector 15 through the cleaner inlet 13.

A drum blade 14 may be arranged at the cleaner inlet 13. The drum blade 14 may be rotatably mounted about the cleaner housing 11. The drum blade 14 may hit the surface to be cleaned to scatter dust. Scattered dust may be introduced into the cleaner inlet 13 together with the ambient air.

Dust and/or air introduced through the cleaner inlet 13 may move to the dust collector 15. The dust and/or air may move to the dust collection chamber 16 through a dust inlet (not shown).

The cleaner housing 11 may be provided with a cleaner outlet portion 18. The cleaner outlet portion 18 may be arranged on the rear side of the robot cleaner 10. The cleaner outlet portion 18 may discharge the air introduced through the cleaner inlet 13 to the outside of the robot cleaner 10 by a suction force generated by a cleaner suction device (not shown).

The robot cleaner 10 may include a battery 19. The battery 19 may be configured to be rechargeable. The battery 19 may provide power required for driving the robot cleaner 10.

The robot cleaner 10 may include a display 17. The display 17 may display a driving state of the robot cleaner 10. The display 17 may be provided as a touch screen so as to receive a user's command. The display 17 may be located at an end opposite to a direction in which the robot cleaner 10 is docked to the robot cleaner station 100. Particularly, because the robot cleaner 10 reverses and then docked to the robot cleaner station 100, the display 17 installed on the front end of the robot cleaner 10 may be exposed to a user even when the robot cleaner 10 is docked to the robot cleaner station 100.

Figure 3:
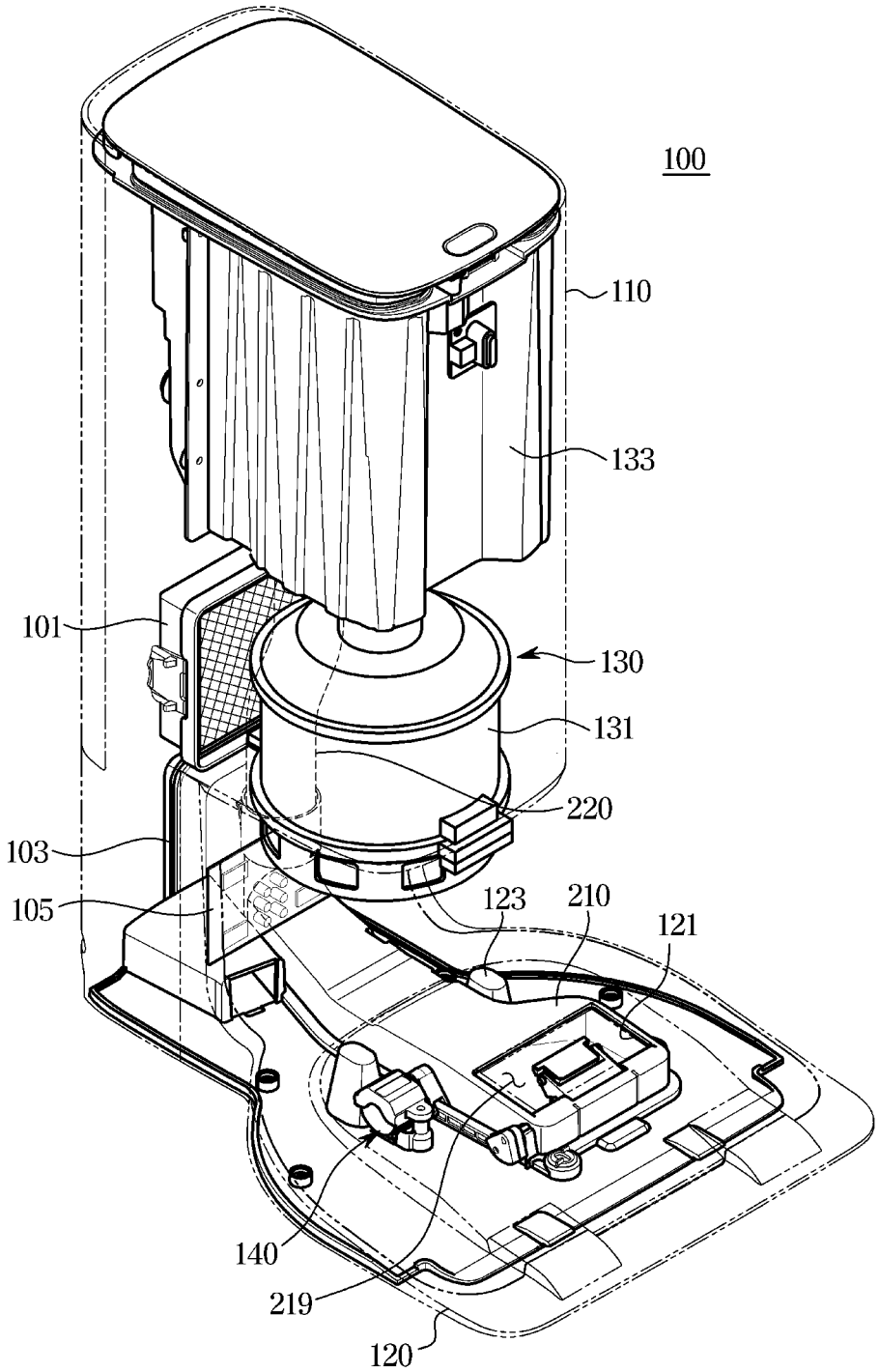
FIG. 3 is a view illustrating an interior of the robot cleaner station according to an embodiment of the disclosure.
Figure 4:
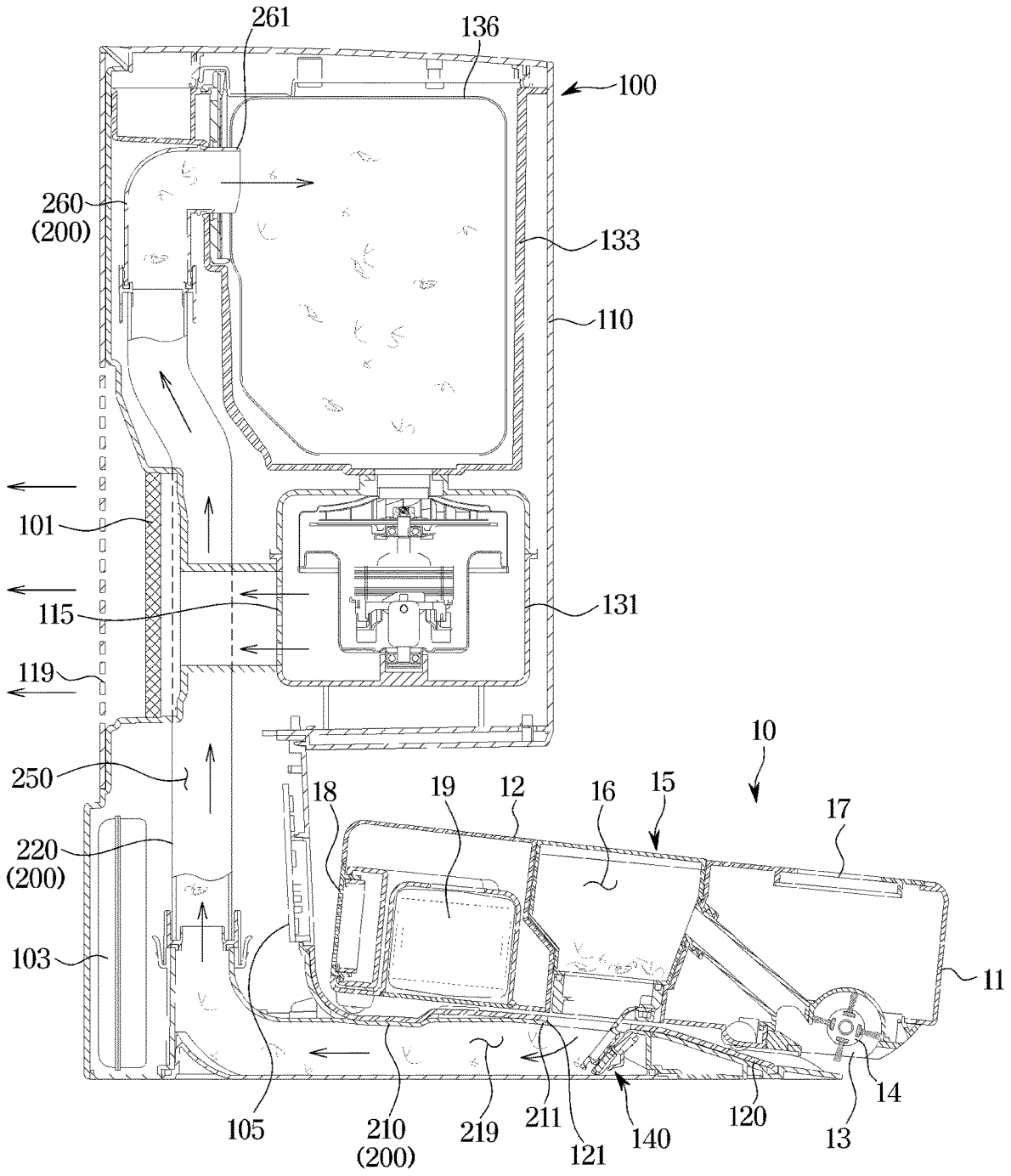
FIG. 4 is a view illustrating a path through which dust is sucked to a collection chamber by a connector of the robot cleaner station according to an embodiment of the disclosure.
Figure 5:
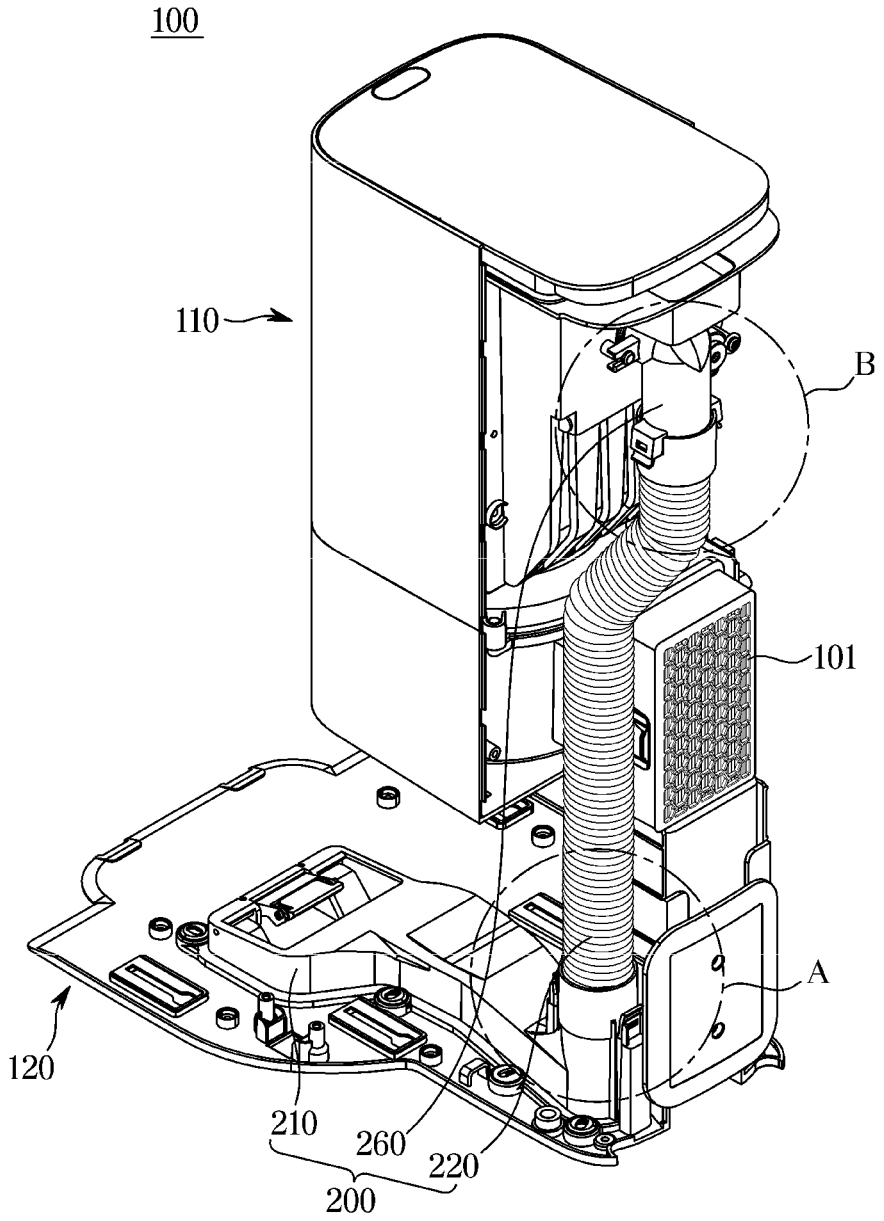
FIG. 5 is a view illustrating a state in which the connection hose according to an embodiment of the disclosure is accommodated in a station housing.

FIG. 3 is a view illustrating an interior of the robot cleaner station according to an embodiment of the disclosure, FIG. 4 is a view illustrating a path through which dust is sucked to a collection chamber by a connector of the robot cleaner station according to an embodiment of the disclosure, and FIG. 5 is a view illustrating a state in which the connection hose according to an embodiment of the disclosure is accommodated in a station housing.

The robot cleaner 10 refers to the drawings illustrated in FIGS. 1 to 2.

As illustrated in FIGS. 3 to 5, the robot cleaner station 100 may include a station housing 110 in which a receiving spaced is formed, and a cleaner docking portion 120 to which the robot cleaner 10 is docked.

When the robot cleaner 10 is docked to the cleaner docking portion 120, the robot cleaner station 100 may charge the battery (not shown) of the robot cleaner 10 or collect dust collected in the dust collection chamber 16 of the robot cleaner 10.

The station housing 110 may include a front housing 111 and a rear housing 113 coupled to the rear of the front housing 111. The rear housing 113 may include a rear cover 117 configured to cover the rear surface of the rear housing 113.

In the inside of the station housing 110, at least a portion of a collector 130 configured to collect dust collected in the dust collection chamber 16 of the robot cleaner 10 may be disposed. Electrical components for charging the battery of the robot cleaner 10 may be disposed inside the station housing 110.

A first air outlet 115 may be formed in the rear housing 113. The first air outlet 115 may be provided to allow a station suction device 131 to discharge air, which is sucked from the dust collection chamber 16 of the robot cleaner 10, to the outside of the robot cleaner station 100. The first air outlet 115 may be disposed on the rear surface of the rear housing 113.

A discharge filter 101 configured to filter air discharged to the first air outlet 115 may be provided on the rear housing 113. The discharge filter 101 may be arranged to filter air discharged from the station suction device 131. The discharge filter 101 may be disposed adjacent to the first air outlet 115. The discharge filter 101 may include a High Efficiency Particulate Air (HEPA) filter.

The rear cover 117 may be provided with a second air outlet 119 configured to discharge air, which is discharged through the first air outlet 115 and filtered by the discharge filter 101, to the outside of the robot cleaner station 100.

A station power board 103 may be provided in the station housing 110. The station power board 103 may be configured to receive power from the outside and convert the power to be suitable for the robot cleaner station 100. The station power board 103 may be positioned at the rear lower side of the station housing 110.

A station controller 105 may be provided in the station housing 110. The station controller 105 may be electrically connected to the station power board 103. The station controller 105 may control a lever device 140. The station controller 105 may allow the lever device 140 to drive when the robot cleaner 10 is docked to the robot cleaner station 100. The station controller 105 may control the station suction device 131. The station controller 105 may control a charging station terminal 123.

The collector 130 may be configured to collect dust collected in the dust collection chamber 16 of the robot cleaner 10. The collector 130 may include the station suction device 131 and a collection chamber 133.

The station suction device 131 may generate a suction force for sucking the dust in the dust collection chamber 16 when the robot cleaner 10 is docked to the robot cleaner station 100. The station suction device 131 may suck dust and/or air from the dust collection chamber 16 of the robot cleaner 10, store the dust in the collection chamber 133, and discharge the air to the outside of the robot cleaner station 100 through the first air outlet 115 and the second air outlet 119.

The collection chamber 133 may filter out dust by filtering air including dust introduced into the robot cleaner station 100 by the station suction device 131 and then collect the dust. The collection chamber 133 may be provided with an apparatus (not shown) for filtering out the dust from air guided by a connector 200. The collection chamber 133 may include a dust bag 136 accommodated in the collection chamber 133. The dust bag 136 may be detachably fastened to the collection chamber 133. When the dust bag 136 is fastened to the collection chamber 133, dust transferred through the connector 200 may be collected in the dust bag 136. When the inside of the dust bag 136 is filled with the dust, the dust bag 136 may be separated from the collection chamber 133 to be discarded. When the dust is transferred through the connector 200 while the dust bag 136 is separated from the collection chamber 133, the dust may be collected in the collection chamber 133. A configuration in which the dust bag 136 is detachably fastened to the collection chamber 133 will be described below.

The cleaner docking portion 120 may be provided to allow the robot cleaner 10 to be docked. The cleaner docking portion 120 may support the lower portion of the station housing 110.

The cleaner docking portion 120 may be provided with a suction port 121 in communication with the dust collection chamber 16 of the robot cleaner 10. The cleaner docking portion 120 may be provided with the station charging terminal 123 for charging the battery of the robot cleaner 10. The station charging terminal 123 may be electrically connected to the battery of the robot cleaner 10 to supply power to the battery when the robot cleaner 10 is docked to the cleaner docking portion 120. The station charging terminal 123 may charge the battery of the robot cleaner 10 using a wireless charging method.

The lever device 140 may be arranged on the cleaner docking portion 120. The lever device 140 may be configured to allow the collector 130 to selectively communicate with the dust collection chamber 16 of the robot cleaner 10.

The robot cleaner station 100 may include the connector 200 configured to connect the suction port 121 to the collection chamber 133. The dust collected in the dust collection chamber 16 of the robot cleaner 10 may be sucked into the suction port 121 communicating with the dust collection chamber 16 by the suction force generated by the station suction device 131. The dust sucked into the suction port 121 may be transferred to the connector 200 by the suction force generated by the station suction device 131. The dust transferred to the connector 200 may be sucked into the collection chamber 133 connected to the connector 200 and then the dust may be collected in the collection chamber 133.

The connector 200 may connect the suction port 121 of the cleaner docking portion 120 to the collection chamber 133. The connector 200 may include a guide portion 210 in communication with the suction port 121, a connection hose 220 including one end detachably fastened to the guide portion 210, and a suction tube 260 to which the other end of the connection hose 220 is detachably fastened and provided in the collection chamber 133. The dust in the dust collection chamber 16 may be sucked through the suction port 121 by the suction force generated by the station suction device 131. The dust sucked through the suction port 121 may be transferred to the guide portion 210 in communication with the suction port 121. The dust transferred to the guide portion 210 may be collected in the collection chamber 133 through the connection hose 220 and the suction tube 260.

The guide portion 210 may include a communication opening 211 in communication with the suction port 121, a first connection hose fastener 213 to which one end of the connection hose 220 is detachably fastened, and a guide flow path 219 provided between the communication opening 211 and the first connection hose fastener 213 so as to guide the dust.

The communication opening 211 may communicate with the suction port 121 and transfer the dust, which is sucked into the suction port 12, to the guide flow path 219. The guide flow path 219 may be extended in a horizontal direction in the cleaner docking portion 120. The guide flow path 219 may be extended from the communication opening 211. The first connection hose fastener 213 may be extended at an angle of 90 degrees or more and 180 degrees or less with respect to the guide flow path 219. On the drawing, the first connection hose fastener 213 is extended at an angle of 90 degrees with respect to the guide flow path 219. A configuration in which the connection hose 220 is detachably fastened to the first connection hose fastener 213 will be described below.

The connection hose 220 may connect the guide portion 210 to the suction tube 260. Opposite ends of the connection hose 220 may be detachably fastened to the guide portion 210 and the suction tube 260, respectively. The connection hose 220 may be formed of a material having flexibility. The connection hose 220 may be accommodated inside the station housing 110. The connection hose 220 may be formed of a material having flexibility so as to optimize the suction flow path 250 provided to connect the guide flow path 219 to the suction tube 260 in the station housing 110. The connection hose 220 may be provided with a stretch hose with adjustable length.

The connection hose 220 may include the first fastener 230 detachably fastened to the guide portion 210, a second fastener 240 detachably fastened to the suction tube 260, and the suction flow path 250 arranged between the first fastener 230 and the second fastener 240 and through which the dust of the dust collection chamber 16 is sucked. A configuration in which the first fastener 230 and the second fastener 240 are detachably fastened to the guide portion 210 and the suction tube 260, respectively, will be described below. The dust sucked through the suction port 121 and transferred to the guide flow path 219 may be transferred to the suction tube 260 through the suction flow path 250.

The suction tube 260 may be provided in the collection chamber 133 to allow dust of the dust collection chamber 16, which is guided to the guide flow path 219, to be sucked into the collection chamber 133.

The suction tube 260 may include an insertion portion 261 inserted into an insertion port 134 of the collection chamber 133, and a second connection hose fastener 263 to which the second fastener 240 of the connection hose 220 is detachably fastened. A configuration in which the second fastener 240 of the connection hose 220 is detachably fastened to the second connection hose fastener 263 will be described below.

Figure 6:
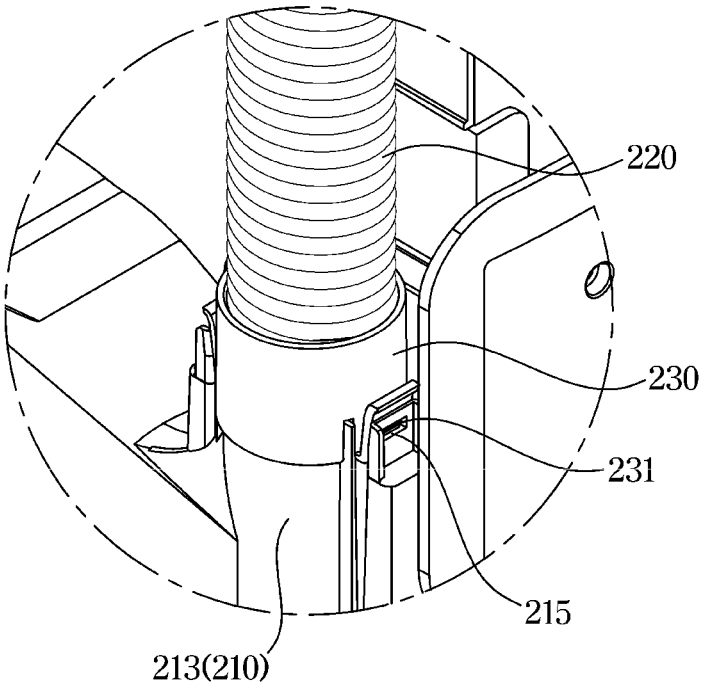
FIG. 6 is an enlarged view of a part A of FIG. 5.
Figure 7:
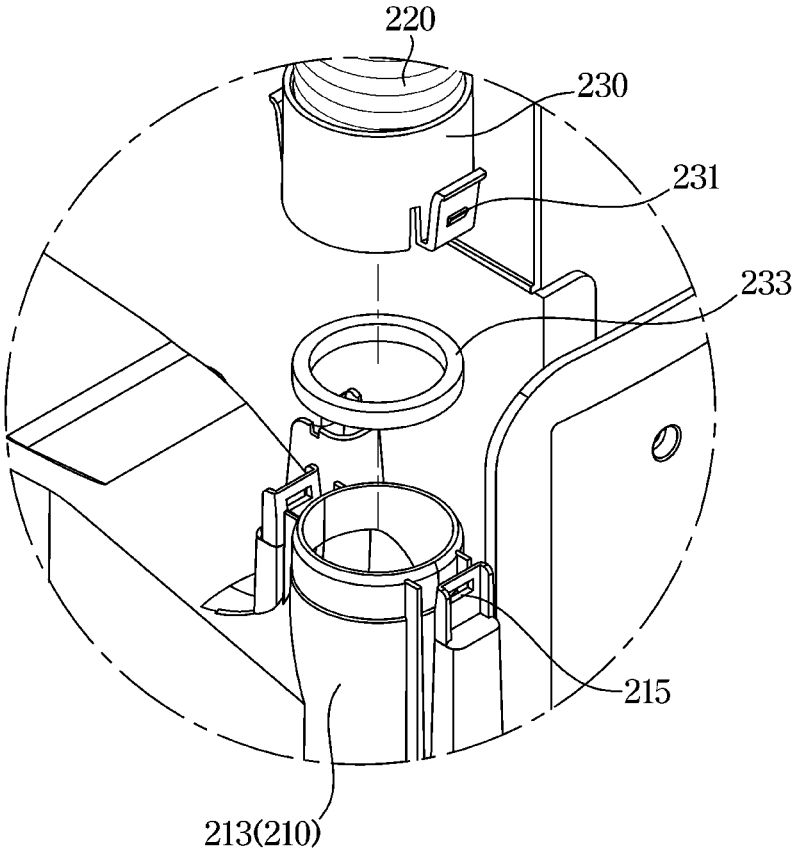
FIG. 7 is a view illustrating a state in which the connection hose is separated from a guide portion of FIG. 6.
Figure 8:
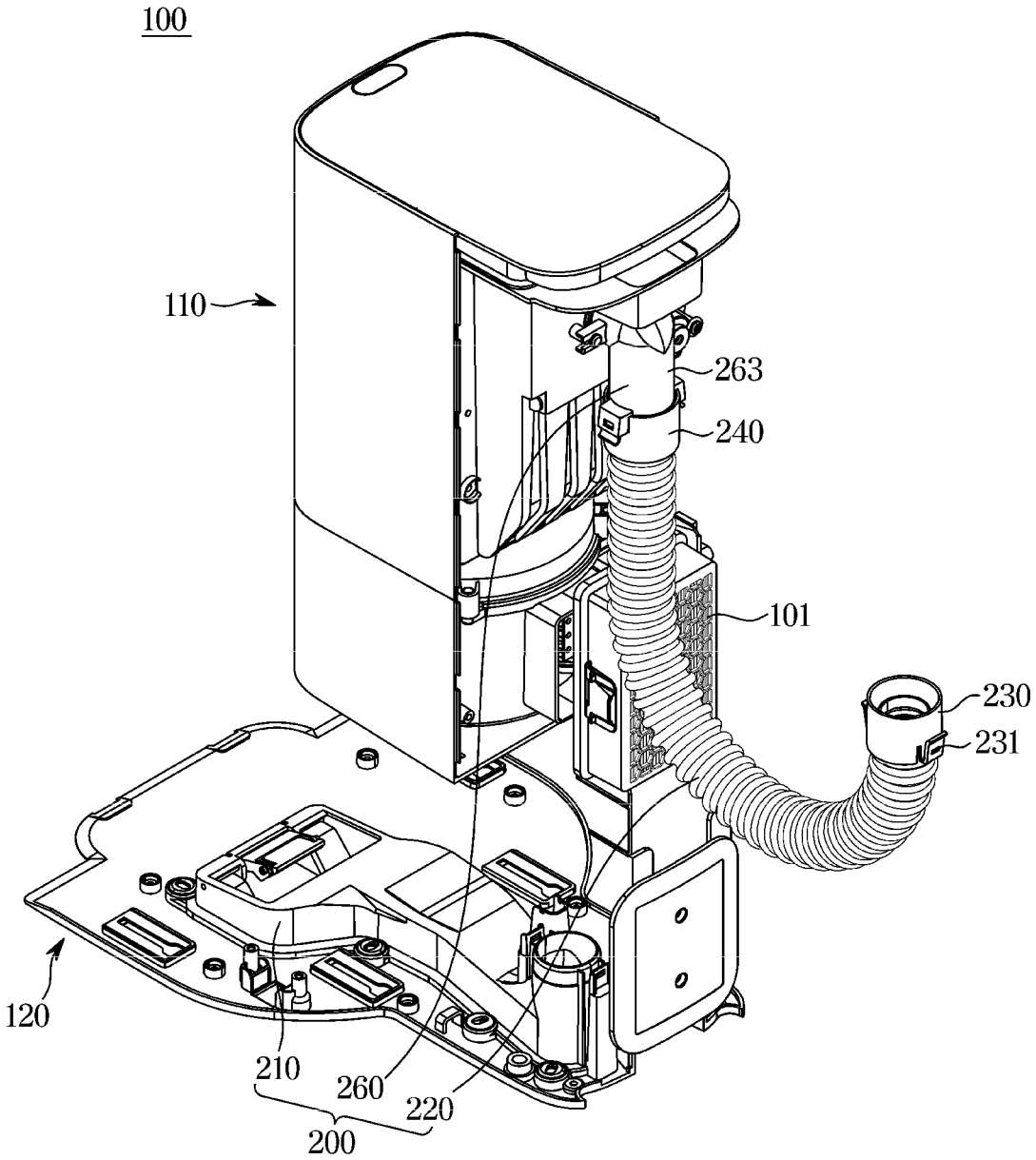
FIG. 8 is a view illustrating a state in which the connection hose according to an embodiment of the disclosure is separated from the guide portion.

FIG. 6 is an enlarged view of a part A of FIG. 5, FIG. 7 is a view illustrating a state in which the connection hose is separated from a guide portion of FIG. 6, and FIG. 8 is a view illustrating a state in which the connection hose according to an embodiment of the disclosure is separated from the guide portion.

As illustrated in FIGS. 6 and 7, the connection hose 220 may include the first fastener 230 detachably fastened to the guide portion 210. The guide portion 210 may include the first connection hose fastener 213 to which the first fastener 230 of the connection hose 220 is detachably fastened.

The first fastener 230 may include a plurality of first hooks 231 detachably fastened to the first connection hose fastener 213, and a first sealing member 233 configured to seal between the first fastener 230 and the first connection hose fastener 213.

The first connection hose fastener 213 may include a plurality of first hook fasteners 215 to which the plurality of first hooks 231 is detachably fastened.

In the drawing, a configuration, in which two pairs of the first hooks 231 and the first hook fastener 215 is provided, is illustrated, but is not limited thereto. Therefore, the first hooks 231 and the first hook fastener 215 may be provided in two or more pairs.

When it needs to manually clean a floor around the robot cleaner station 100, the connection hose 220 may be separated from the guide portion 210 to clean the floor around the robot cleaner station 100, as illustrated in FIG. 8 because the connection hose 220 is detachably fastened to the guide portion 210. In a state in which the connection hose 220 is separated from the guide portion 210, the floor around the robot cleaner station 100 may be directly cleaned with the connection hose 220. After the floor around the robot cleaner station 100 is directly cleaned with the connection hose 220, the connection hose 220 may be fastened to the guide portion 210 again.

Figure 9:
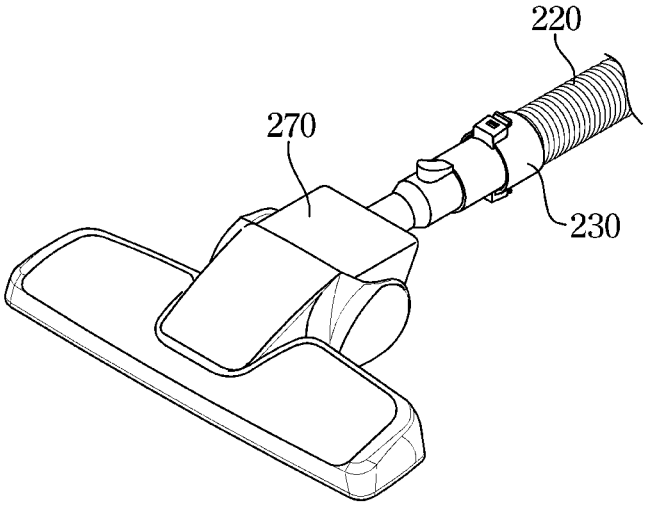
FIG. 9 is a view illustrating a state in which a brush head is fastened to the connection hose according to an embodiment of the disclosure.
Figure 10:
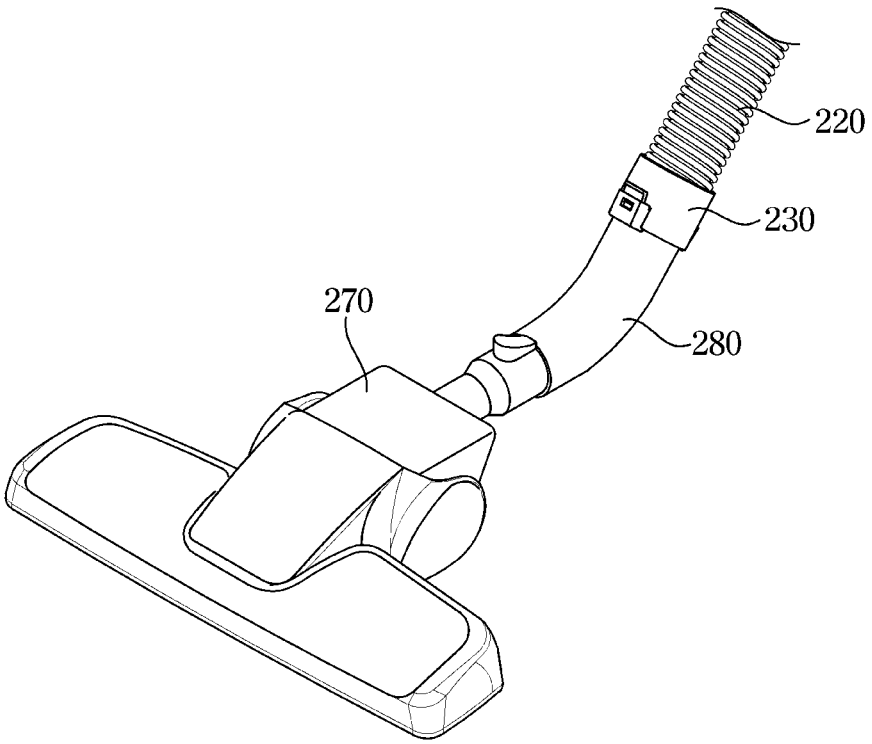
FIG. 10 is a view illustrating a state in which an extension hose is fastened to the connection hose according to an embodiment of the disclosure and the brush head is fastened to the extension hose.

FIG. 9 is a view illustrating a state in which a brush head is fastened to the connection hose according to an embodiment of the disclosure and FIG. 10 is a view illustrating a state in which an extension hose is fastened to the connection hose according to an embodiment of the disclosure and the brush head is fastened to the extension hose.

As illustrated in FIG. 9, in a state of being separated from the guide portion 210 (refer to FIG. 8), the connection hose 220 may be used by being fastened to an accessory 270 such as a brush head. The accessory 270, such as a brush head, may be detachably fastened to the connection hose 220. The connection between the accessory 270 such as a brush head and the connection hose 220 may have the same structure as the connection between the connection hose 220 and the guide portion 210 illustrated in FIGS. 6 to 7. When the brush head is fastened to the connection hose 220, the floor around the robot cleaner station 100 (refer to FIG. 8) may be cleaned more efficiently. After cleaning the floor around the robot cleaner station 100 (refer to FIG. 8) with the brush head, the brush head may be separated from the connection hose 220, and the connection hose 220 may be fastened to the guide portion 210.

As illustrated in FIG. 10, in a state of being separated from the guide portion 210 (refer to FIG. 8), the connection hose 220 may be used by being fastened to an extension hose 280. The extension hose 280 may extend the length of the connection hose 220. The connection between the extension hose 280 and the connection hose 220 may have the same structure as the connection between the connection hose 220 and the guide portion 210 illustrated in FIGS. 6 to 7. In the state in which the extension hose 280 is fastened to the connection hose 220, the floor around the robot cleaner station 100 (refer to FIG. 8) may be cleaned, or in a state in which the accessory 270 such as a brush head is additionally fastened to the extension hose 280, the cleaning may be performed. After the completion of the cleaning, the brush head may be separated from the extension hose 280. After the separation of the brush head, the extension hose 280 may be separated from the connection hose 220. After the separation of the extension hose 280, the connection hose 220 may be fastened to the guide portion 210.

Figure 11:
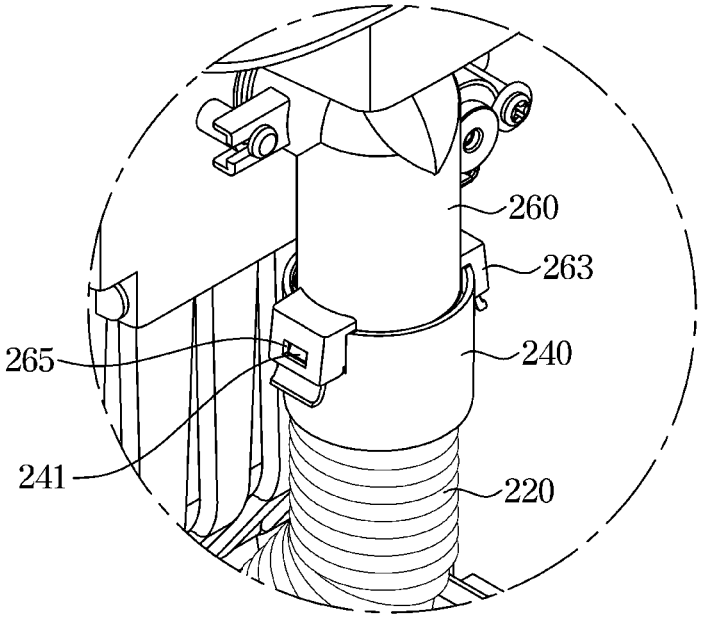
FIG. 11 is an enlarged view of a part B of FIG. 5.
Figure 12:
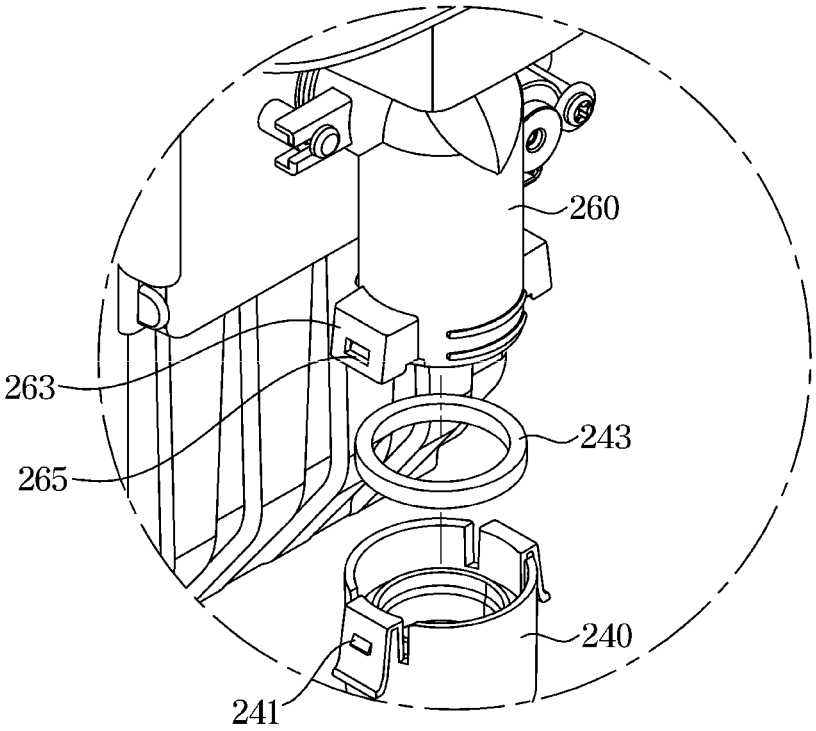
FIG. 12 is a view illustrating a state in which the connection hose is separated from a suction tube of FIG. 11.
Figure 13:
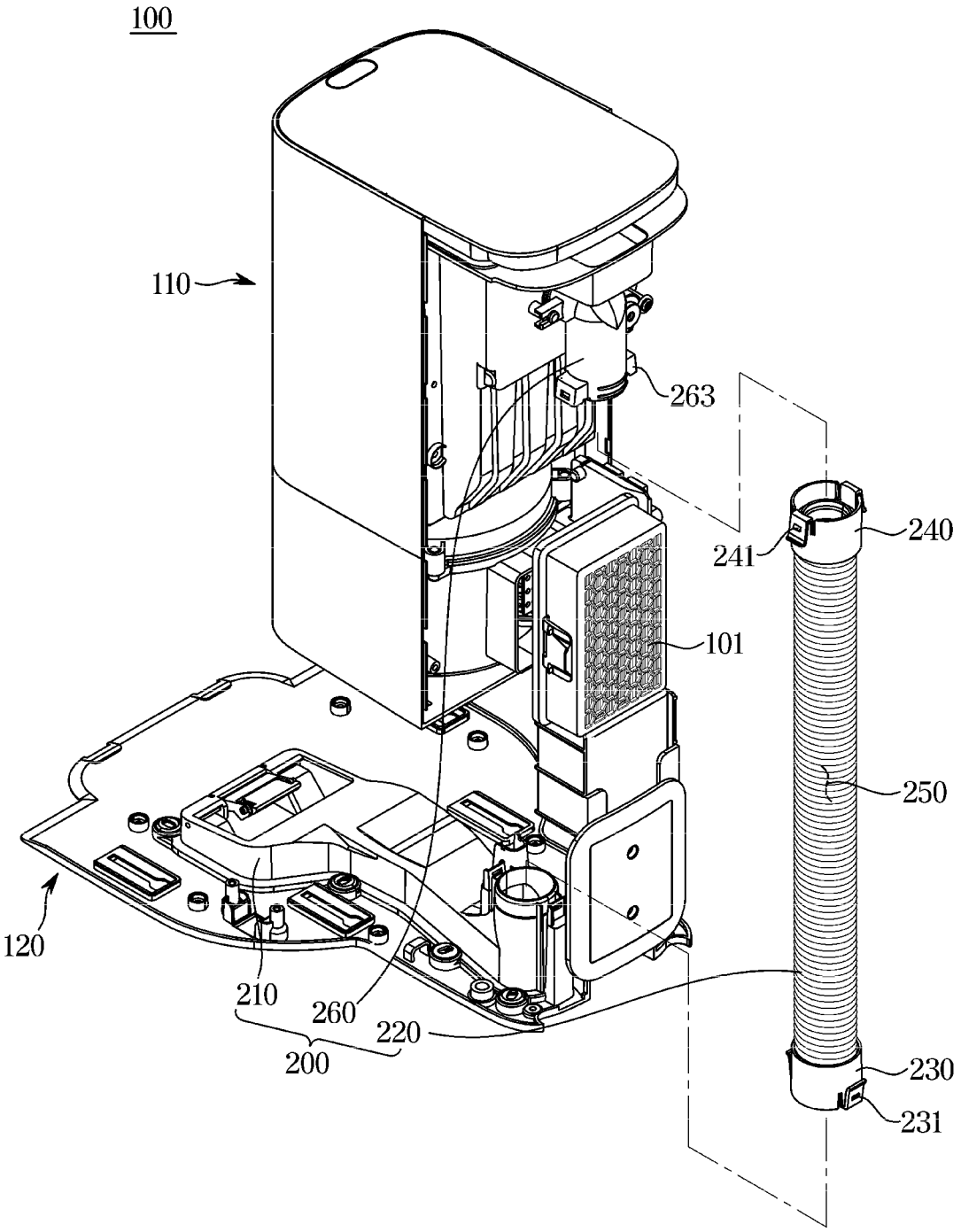
FIG. 13 is a view illustrating a state in which the connection hose according to an embodiment of the disclosure is separated from the guide portion and the suction tube.

FIG. 11 is an enlarged view of a part B of FIG. 5, FIG. 12 is a view illustrating a state in which the connection hose is separated from a suction tube of FIG. 11, and FIG. 13 is a view illustrating a state in which the connection hose according to an embodiment of the disclosure is separated from the guide portion and the suction tube.

As illustrated in FIGS. 11 and 12, the connection hose 220 may include the second fastener 240 detachably fastened to the suction tube 260. The suction tube 260 may include the second connection hose fastener 263 to which the second fastener 240 of the connection hose 220 is detachably fastened.

The second fastener 240 may include a plurality of second hooks 241 detachably fastened to the second connection hose fastener 263, and a second sealing member 243 configured to seal between the second fastener 240 and the second connection hose fastener 263.

The second connection hose fastener 263 may include a plurality of second hook fasteners 265 to which the plurality of second hooks 241 is detachably fastened.

In the drawing, a configuration, in which two pair of the second hooks 241 and the second hook fastener 265 is provided, is illustrated, but is not limited thereto. Therefore, the second hooks 241 and the second hook fastener 265 may be provided in two or more pairs.

The connection hose 220 may be separated from the suction tube 260, as illustrated in FIG. 13, because the connection hose 220 is detachably fastened to the suction tube 260, and thus when dust is caught in the suction flow path 250, the dust caught in the suction flow path 250 may be easily removed. After removing the dust caught in the suction flow path 250, opposite ends of the connection hose 220 may be fastened to the guide portion 210 and the suction tube 260, respectively.

Figure 14:
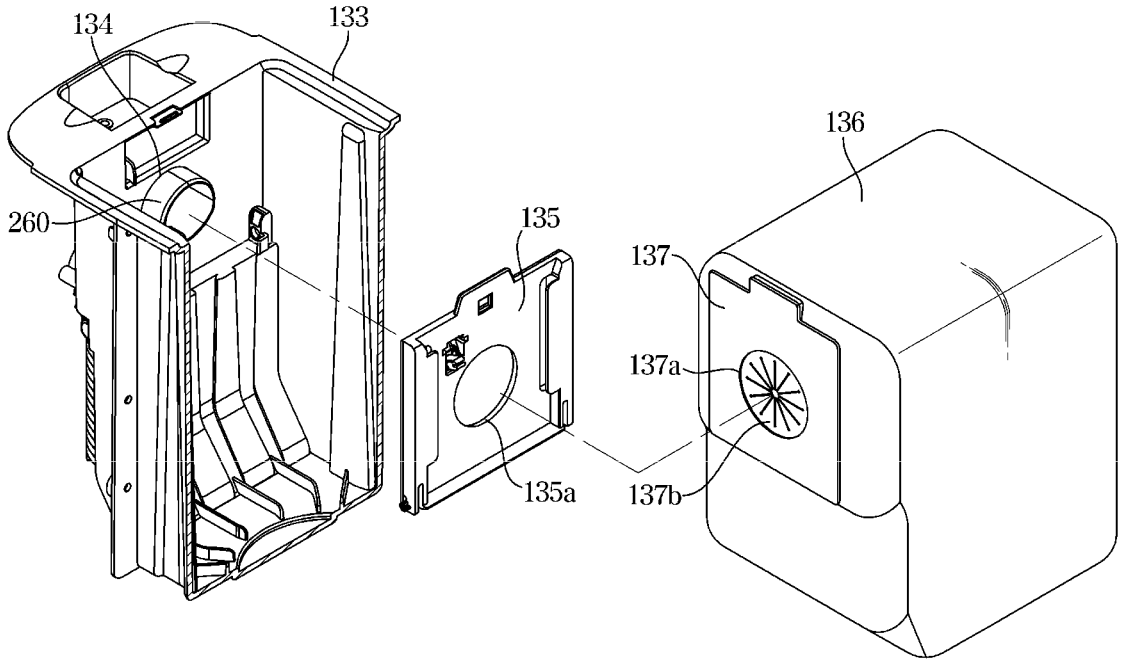
FIG. 14 is a view illustrating a part of the collection chamber according to an embodiment of the disclosure.

FIG. 14 is a view illustrating a part of the collection chamber according to an embodiment of the disclosure.

As illustrated in FIG. 14, the collection chamber 133 may be provided with the suction tube 260 through which the dust of the dust collection chamber 16 (refer to FIG. 4) is sucked.

The collection chamber 133 may include the insertion port 134 to which the suction tube 260 is inserted, the dust bag 136 accommodated in the inside of the collection chamber 133, a bag fastener 135 to which the dust bag 136 is detachably fastened, and a chamber fastener 137 to which the bag fastener 135 is detachably fastened.

The dust bag 136 may be detachably fastened to the collection chamber 133. The collection chamber 133 may include the bag fastener 135 to allow the dust bag 136 to be detachably fastened to the collection chamber 133. The bag fastener 135 may include a first opening 135*a* formed at a position corresponding to the insertion port 134 and into which the suction tube 260 is inserted. The dust bag 136 may include the chamber fastener 137 configured to allow the dust bag 136 to be detachably fastened to the bag fastener 135. The chamber fastener 137 may include a second opening 137*a* formed at a position corresponding to the insertion port 134 and into which the suction tube 260 is inserted. A plurality of dust blocking members 137*b* formed of a material having flexibility may be provided in the second opening 137*a*. When the dust bag 136 is separated from the bag fastener 135, the plurality of dust blocking members 137*b* may prevent dust collected in the dust bag 136 from being discharged to the outside of the dust bag 136.

When the dust bag 136 is fastened to the collection chamber 133, dust transferred through the connector 200 (refer to FIG. 4) may be collected in the dust bag 136. When the inside of the dust bag 136 is filled with the dust, the dust bag 136 may be separated from the collection chamber 133 to be discarded. When the dust is transferred through the connector 200 while the dust bag 136 is separated from the collection chamber 133, the dust may be collected in the collection chamber 133.

Figure 15:
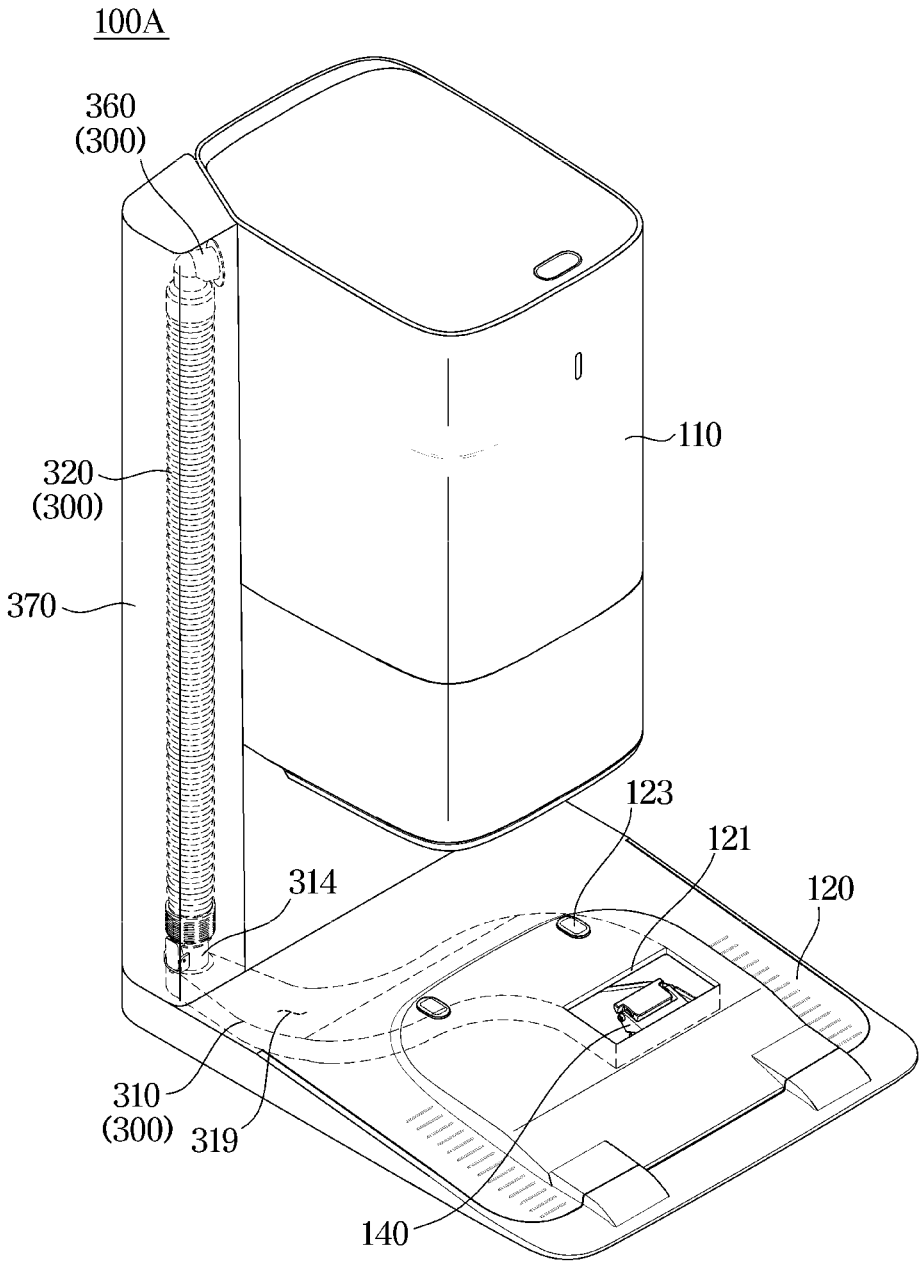
FIG. 15 is a perspective view illustrating a robot cleaner station according to another embodiment of the disclosure.

FIG. 15 is a perspective view illustrating a robot cleaner station according to another embodiment of the disclosure.

As illustrated in FIG. 15, a connection hose 320 of a connector 300 may be arranged on the outside of a station housing 110. When the connection hose 320 is provided to be arranged on the outside of the station housing 110, a robot cleaner station 100A may include a connection hose cover 370 configured to prevent the connection hose 320 from being exposed to the outside. When the connection hose 320 is provided to be arranged on the outside of the station housing 110, a guide portion 310 configured to guide dust sucked through a suction port 121 to the connection hose 320 may be different from the guide portion 210 illustrated in FIG. 3. Further, a position of a suction tube 360 may be different from the position of the suction tube 260 illustrated in FIG. 5.

Particularly, the guide portion 210 illustrated in FIG. 3 is extended from the suction port 121 to the inside of the station housing 110, but the guide portion 310 is extended from the suction port 121 to the outside of the station housing 110. In the drawing, it is illustrated that the guide portion 310 is extended to the left side of the station housing 110 because the connection hose 320 is arranged on the left side of the station housing 110. Because the guide portion 310 is extended from the inside of a cleaner docking portion 120, the cleaner docking portion 120 may have a relatively large area.

The position of the suction tube 360 may also be provided on the left side of the station housing 110 to correspond to the position where the connection hose 320 is arranged.

Figure 16:
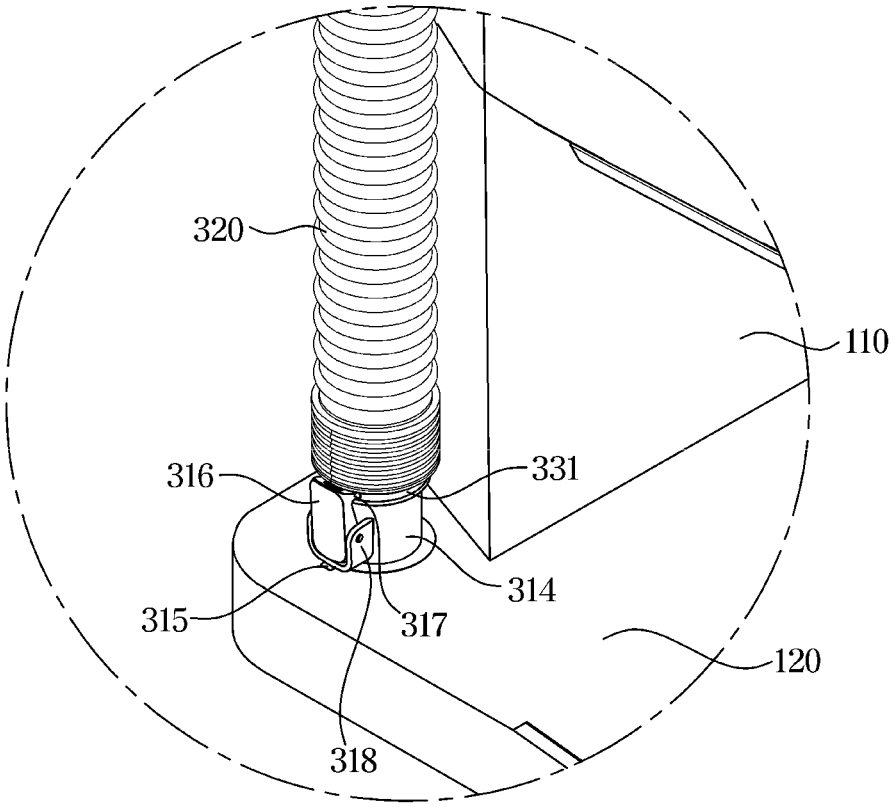
FIG. 16 is a view illustrating a state in which a connection hose according to another embodiment of the disclosure is fastened to a button holder fastened to a guide portion.
Figure 17:
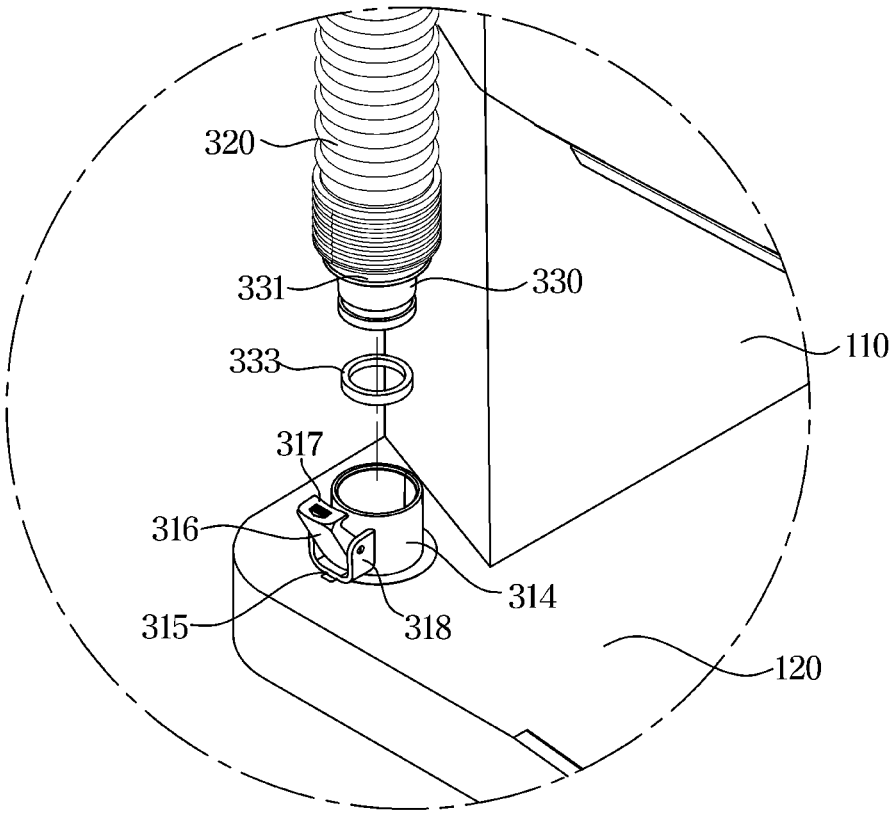
FIG. 17 is a view illustrating a state in which the connection hose of FIG. 16 is separated from the button holder.
Figure 18:
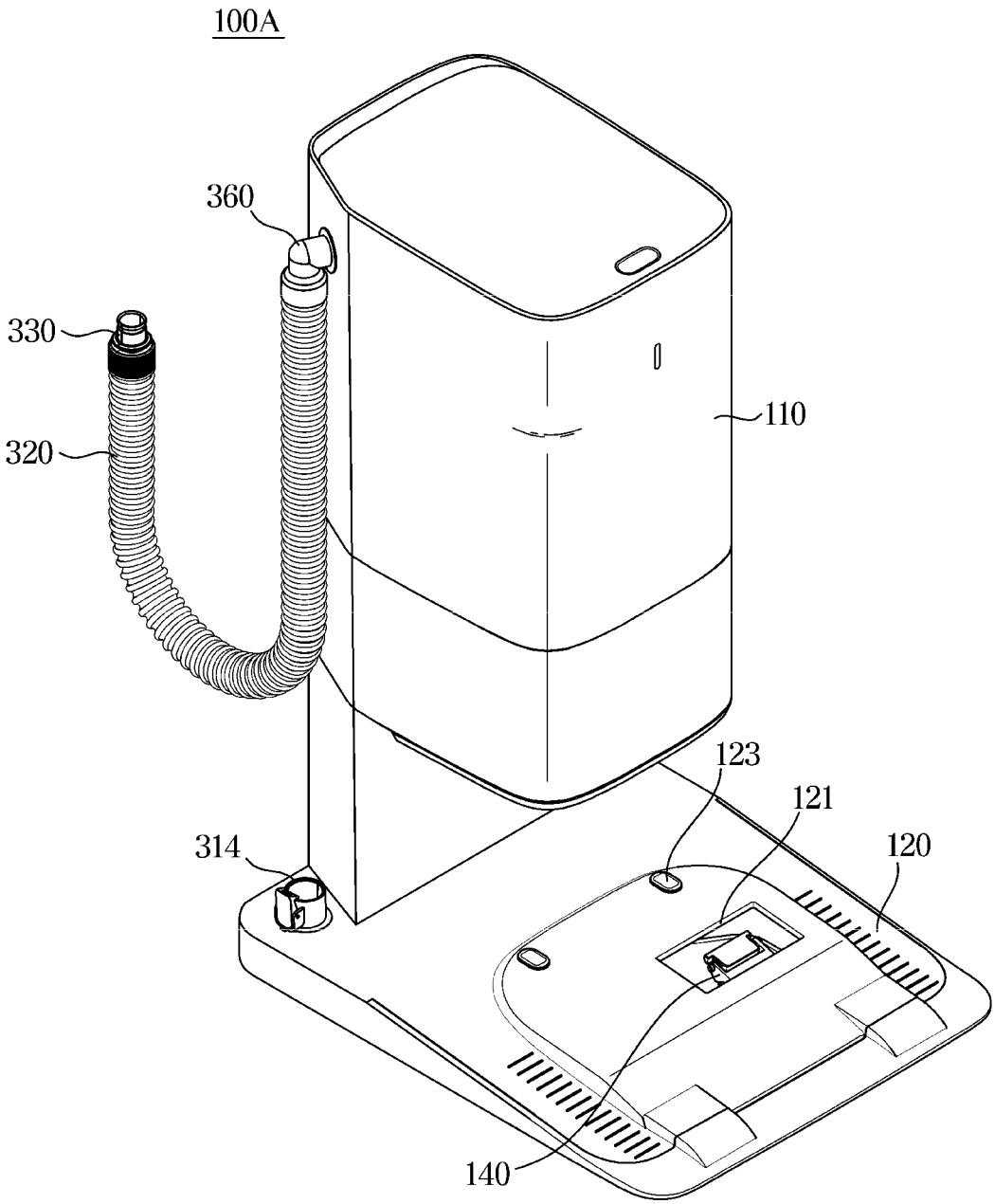
FIG. 18 is a view of the robot cleaner station in which the connection hose according to another embodiment of the disclosure is separated from the button holder.

FIG. 16 is a view illustrating a state in which a connection hose according to another embodiment of the disclosure is fastened to a button holder fastened to a guide portion, FIG. 17 is a view illustrating a state in which the connection hose of FIG. 16 is separated from the button holder, and FIG. 18 is a view of the robot cleaner station in which the connection hose according to another embodiment of the disclosure is separated from the button holder.

As illustrated in FIGS. 16 and 17, the connection hose 320 may include a first fastener 330 detachably fastened to a button holder 314. The button holder 314 may include a button 316 detachably fastened to the first fastener 330. The button holder 314 may correspond to a first connection hose fastener.

The first fastener 330 may include a protrusion 331 to which the button 316 is detachably fastened, and a first sealing member 333 configured to seal between the first fastener 330 and the button holder 314.

The button 316 may include a hook 317 detachably fastened to the protrusion 331. The button 316 may be rotatably supported by a button support 318. The hook 317 may be fastened to or separated from the protrusion 331 by rotation of the button 316. When a user presses a lower portion of the button 316 in a state in which the hook 317 is fastened to the protrusion 331, the button 316 may be rotated and thus the hook 317 may be separated from the protrusion 331. When the hook 317 is separated from the protrusion 331, the connection hose 320 may be separated from the button holder 314 and used to manually clean the floor around the robot cleaner station 100A, as illustrated in FIG. 18. When the force of the user pressing the button 316 is removed, the button 316 may be rotated back to its original state by a spring (not shown). Although not illustrated in the drawings, the connection hose 320 may be used by being fastened to an accessory such as a brush head or an extension hose in a state in which the connection hose 320 is separated from the button holder 314, as illustrated in FIGS. 9 and 10.

Figure 19:
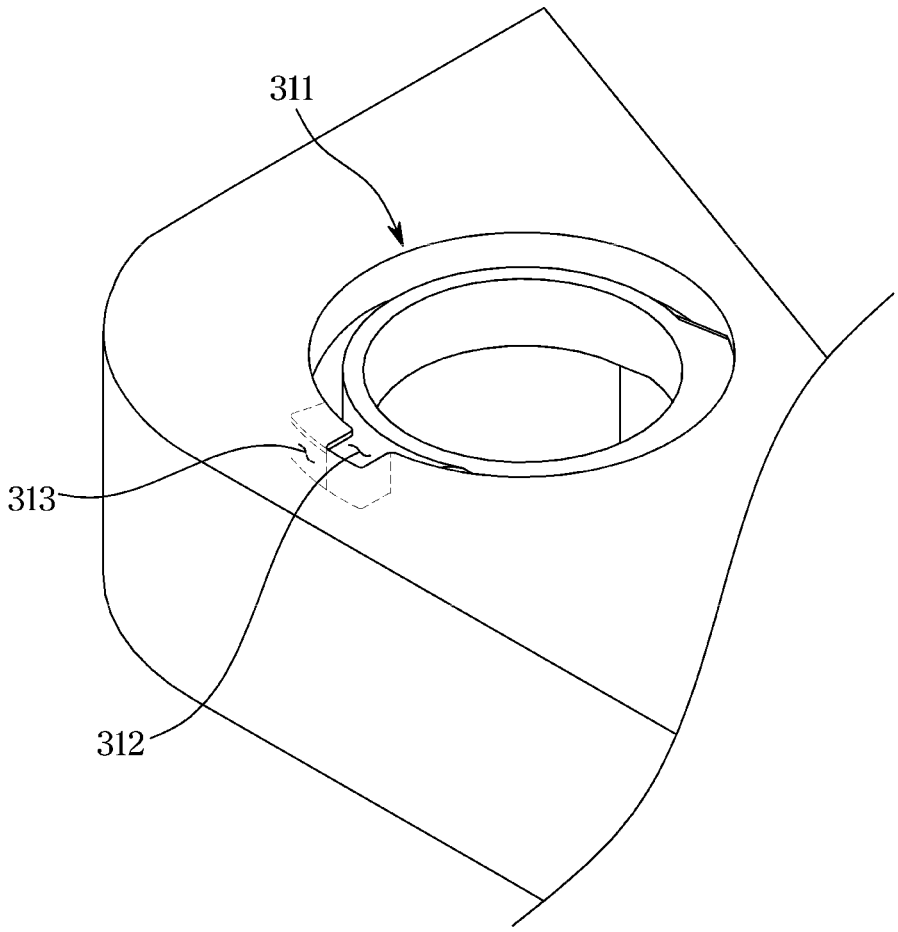
FIG. 19 is a view illustrating a button holder fastener of a guide portion according to another embodiment of the disclosure.
Figure 20:
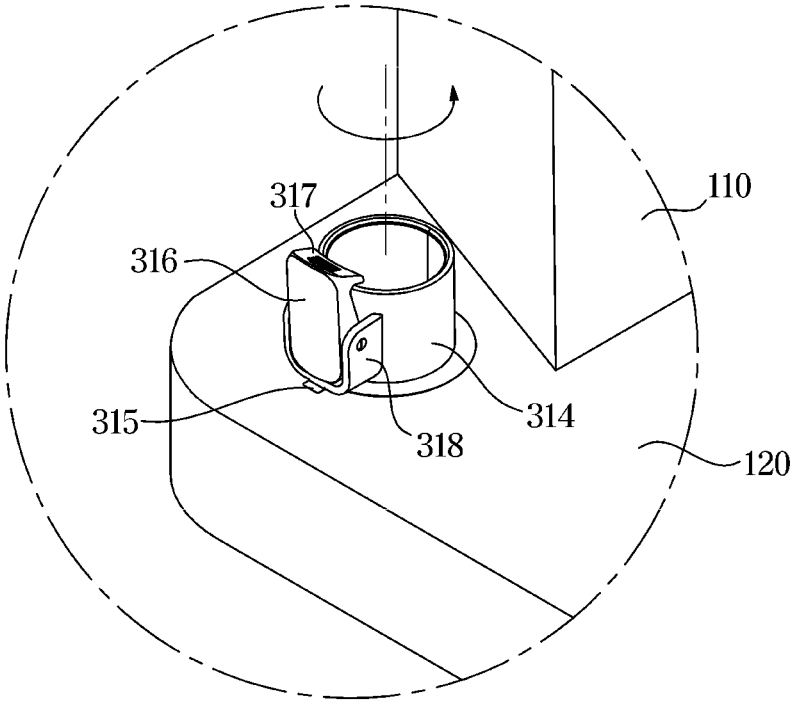
FIG. 20 is a view illustrating a state in which the button holder is rotated to be separated from the button holder fastener of FIG. 17.
Figure 21:
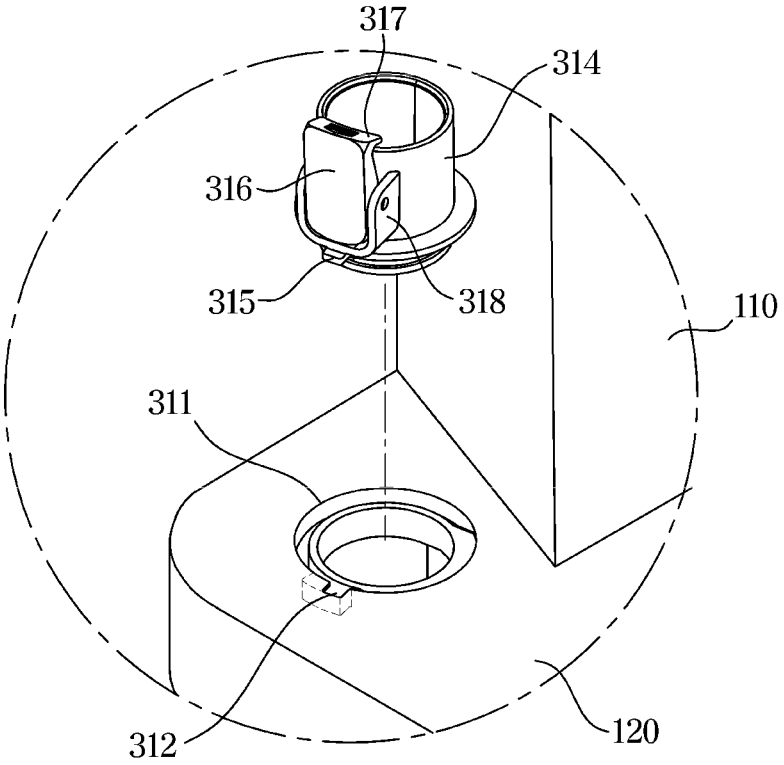
FIG. 21 is a view illustrating a state in which the button holder is separated from the button holder fastener of FIG. 20.

FIG. 19 is a view illustrating a button holder fastener of a guide portion according to another embodiment of the disclosure, FIG. 20 is a view illustrating a state in which the button holder is rotated to be separated from the button holder fastener of FIG. 17, and FIG. 21 is a view illustrating a state in which the button holder is separated from the button holder fastener of FIG. 20.

As illustrated in FIGS. 19 to 21, the guide portion 310 may include a button holder fastener 311 to which the button holder 314 is detachably fastened. The button holder fastener 311 may include an insertion groove 312 to which a fixing protrusion 315 of the button holder 314 is inserted, and a fixing groove 313 configured to rotate the fixing protrusion 315 inserted to the insertion groove 312 so as to fix the fixing protrusion 315. In the drawings, it is illustrated that the fixing protrusion 315 is moved from the fixing groove 313 to the insertion groove 312 by rotating the button holder 314 counterclockwise. When the fixing protrusion 315 is moved to the insertion groove 312, the button holder 314 may be moved upward and then separated from the button holder fastener 311.

Although a state in which the button holder 314 is separated from the button holder fastener 311 is illustrated in the drawings, the button holder 314 may be fastened to the button holder fastener 311. When the fixing protrusion 315 of the button holder 314 is inserted into the insertion groove 312 of the button holder fastener 311 and then the button holder 314 is rotated counterclockwise, the fixing protrusion 315 may be moved to the fixing groove 313 and then the button holder 314 may be fastened to the button holder fastener 311.

The button holder 314 may be detachably fastened to the button holder fastener 311. Therefore, when the connection hose 320 is used by being fastened to the accessory such as the brush head or the extension hose, according to the fastening structure of the accessory such as the brush head or the extension hose, the connection hose 320 may be used by being separated from the button holder 314 or by separating the button holder 314 from the button holder fastener 311. When the connection hose 320 is used by separating the button holder 314 from the button holder fastener 311, the button holder 314 may be still fastened to the connection hose 320.

Figure 22:
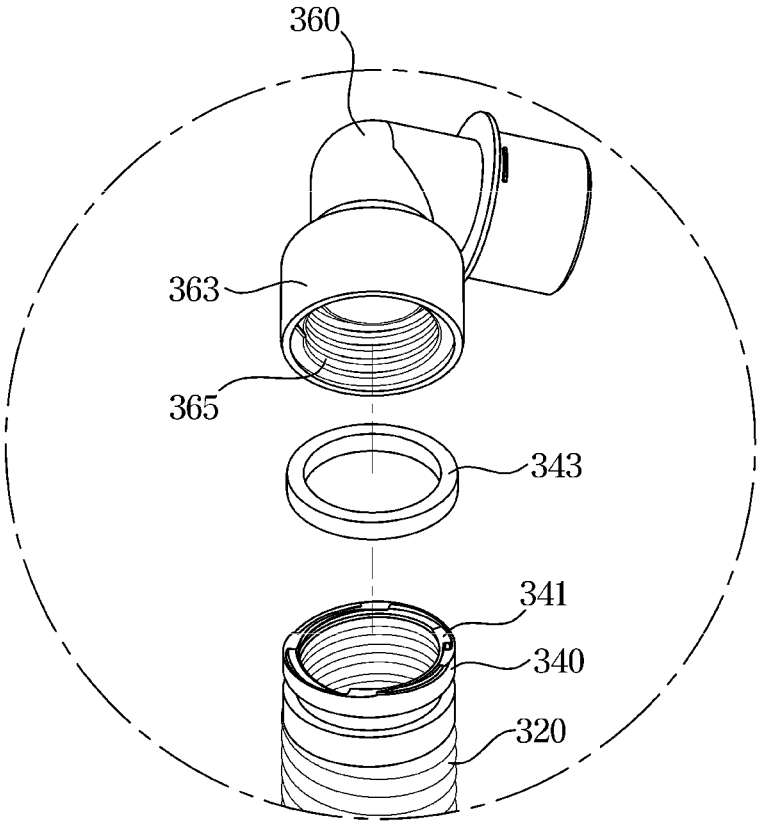
FIG. 22 is a view illustrating a state in which the connection hose according to another embodiment of the disclosure is separated from a suction tube.

FIG. 22 is a view illustrating a state in which the connection hose according to another embodiment of the disclosure is separated from a suction tube.

As illustrated in FIG. 22, the connection hose 320 may include a second fastener 340 detachably fastened to the suction tube 360. The suction tube 360 may include a second connection hose fastener 363 to which the second fastener 340 is detachably fastened.

The second fastener 340 may include a first screw 341 detachably fastened to the second connection hose fastener 363, and a second sealing member 343 configured to seal between the second fastener 340 and the second fastener 340.

The second connection hose fastener 363 may include a second screw 365 which the first screw 341 is rotated to be fastened to or separated from.

Because the connection hose 320 is detachably fastened to the suction tube 360, the connection hose 320 may be separated from the button holder 314 and the suction tube 360 and thus when dust is caught in the connection hose 320, the dust caught in the connection hose 320 may be easily removed. After the dust caught in the connection hose 320 is removed, opposite ends of the connection hose 320 may be fastened to the button holder 314 and the suction tube 360, respectively.

In the drawing, it is illustrated that the second fastener 340 is provided as the first screw 341 and the second connection hose fastener 363 is provided as the second screw and thus the first screw 341 is rotated with respect to the second screw 363 so as to be fastened to or separated from the second screw 363. Alternatively, the second fastener 340 of the connection hose 320 may be fastened to the second connection hose fastener 363 of the suction tube 360 by welding. When the connection hose 320 is fastened to the suction tube 360 by welding, the connection hose 320 and the suction tube 360 may not be separable from each other.

As for the configuration in which the connection hose 220 is accommodated in the station housing 110, the configuration in which the connection hose 220 is separable from the guide portion 210 and the suction tube 260 has been described as illustrated in FIGS. 6, 7, 11 and 12, and as for the configuration in which the connection hose 320 is arranged on the outside of the station housing 110, the configuration in which the button holder 314 is detachably fastened to the guide portion 310 and the connection hose 320 is detachably fastened to the button holder 314 and the suction tube 360 has been described as illustrated in FIGS. 16, 17, 19 to 21, but is not limited thereto. That is, the fastening structure as illustrated in FIGS. 16, 17, 19 to 21 may be applicable to the configuration in which the connection hose 220 is accommodated in the station housing 110. Further, the fastening structure as illustrated in FIGS. 6, 7, 11 and 12 may be applicable to the configuration the connection hose 320 is arranged on the outside of the station housing 110.

As is apparent from the above description, it is possible to optimize the suction flow path to suck the dust, which is sucked from the dust collector of the robot cleaner, into the collection chamber.

In addition, opposite ends of the connection hose forming the suction flow path are detachably fastened to the guide portion and the collection chamber, respectively, and thus a cleaning function may be manually performed through the connection hose.

A robot cleaner station comprises a cleaner docking portion to which a robot cleaner is docked and comprising an suction port in communication with a dust collector of the robot cleaner when the robot clear is docked to the cleaner docking portion, a collector comprising a collection chamber in which dust sucked from the dust collector through the suction port is collected, and a station suction device configured to generate a suction force to suck the dust from the dust collector to the collection chamber, and a connector configured to connect the suction port to the collection chamber. The connector comprises a guide portion in communication with the suction port to guide the dust sucked from the dust collector, and extended in a horizontal direction in the cleaner docking portion, a suction tube provided in the collection chamber to allow the dust which is guided by the guide portion to be sucked to the collection chamber, and a connection hose formed of a flexible material and configured to connect the guide portion to the suction tube, the connection hose comprising a first end and a second end detachable from, or attachable and fastened to the guide portion and the suction tube, respectively.

The robot cleaner station further comprises a station housing in which the collector and the connection hose are accommodated.

The first end is a first fastener and the second end is a second fastener, and a suction flow path is formed between the first fastener and the second fastener to allow the dust from the dust collector to be sucked therein.

The guide portion comprises a communication opening in communication with the suction port, and a first connection hose fastener to which the first fastener is attachable and fastened, and a guide flow path is formed between the communication opening and the first connection hose fastener so as to guide the dust from the dust collector.

The first connection hose fastener comprises a plurality of first hook fasteners and the first fastener comprises a plurality of first hooks detachable from, and attachable and fastened to the plurality of first hook fasteners, respectively, and a first sealing member configured to seal between the first fastener and the first connection hose fastener When the first fastener is detached from the first connection hose fastener of the guide portion, dust on the floor is manually cleaned with the connection hose.

An accessory for manually cleaning the floor and an extension hose configured to increase a length of the connection hose are detachable from, or attachable and fastened to the first fastener.

The first fastener comprises a protrusion to which a button holder configured to fasten the connection hose and the guide portion is detachable from, or attachable and fastened, and the guide portion comprises a communication opening in communication with the suction port, a button holder fastener to which the button holder is detachable from or attachable and fastened, and a guide flow path formed between the communication opening and the button holder fastener so as to guide the dust from the dust collector.

The button holder comprises a fixing protrusion detachable from, or attachable and fixed to the button holder fastener and a button comprising a hook detachable from, or attachable and fastened to the protrusion, and the button holder fastener comprises an insertion groove into which the fixing protrusion is inserted, and a fixing groove to which the fixing protrusion inserted into the insertion groove is rotated and fixed.

The collection chamber comprises an insertion port into which the suction tube is inserted, and the suction tube comprises an insertion portion inserted into the insertion port and a second connection hose fastener to which the second fastener is detachable from, or attachable and fastened.

The second connection hose fastener comprises a plurality of second hook fasteners and the second fastener comprises a plurality of second hooks detachable from, or attachable and fastened to the plurality of second hook fasteners, respectively, and a second sealing member configured to seal between the second fastener and the second connection hose fastener.

The second connection hose fastener comprises a second screw and the second fastener comprises a first screw detachable from, or attachable and fastened to the second screw, and a second sealing member configured to seal between the second fastener and the second connection hose fastener.

The collection chamber comprises a dust bag accommodated in the collection chamber and in which the dust from the dust collector is collected, and the suction tube is connected to the dust bag.

The first connection hose fastener is extended at about an angle of 90 degrees or more and about 180 degrees or less with respect to the guide flow path.

The connection hose is arranged on outside of the station housing in which the collector is accommodated, and the guide portion is extended from inside of the cleaner docking portion to the outside of the station housing in a horizontal direction so as to be connected to the connection hose.

A cleaner docking portion to which a robot cleaner is docked and comprising an suction port in communication with a dust collector of the robot cleaner when the robot clear is docked to the cleaner docking portion, a collection chamber comprising a dust bag in which dust sucked from the dust collector through the suction port is collected, a station suction device configured to generate a suction force to suck the dust from the dust collector to the dust bag, and a connector configured to connect the suction port to the collection chamber, and the connector comprises a guide portion in communication with the suction port to guide the dust sucked from the dust collector and extended in a horizontal direction in the cleaner docking portion, a suction tube provided in the collection chamber to allow the dust which is guided by the guide portion to be sucked to the dust bag, and a connection hose formed of a flexible material and configured to connect the guide portion to the suction tube, and configured to be detachable from, or attachable and fastened to the guide portion when the connection hose is detached from the guide portion, the connection hose is used to suck dust on a floor for manual cleaning.

The connection hose comprises a first fastener detachable from, or attachable and fastened to the guide portion, a second fastener detachable from, or attachable and fastened to the suction tube, and a suction flow path provided between the first fastener and the second fastener to allow the dust from the dust collector to be sucked therein.

When dust is caught in the suction flow path, the first fastener and the second fastener are respectively detached from the guide portion and the suction tube to remove the dust caught in the suction flow path.

The collection chamber comprises a bag fastener to which the dust bag is detachable from, or attachable and fastened, and the dust bag comprises a chamber fastener detachable from, or attachable and fastened to the bag fastener.

The collection chamber comprises an insertion port into which the suction tube is inserted, and the bag fastener and the chamber fastener comprise a first opening and a second opening provided at a position corresponding to the insertion port so as to communicate with the insertion port.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A robot cleaner station comprising:

a cleaner docking portion to which a robot cleaner is docked and comprising an suction port in communication with a dust collector of the robot cleaner when the robot cleaner is docked to the cleaner docking portion;

a collector comprising:

a collection chamber in which dust sucked from the dust collector through the suction port is collected; and a station suction device configured to generate a suction force to suck the dust from the dust collector to the collection chamber;

a station housing in which the collector is accommodated; and a connector configured to connect the suction port to the collection chamber, wherein the connector comprises:

a guide portion in communication with the suction port to guide the dust sucked from the dust collector, and extended in a horizontal direction in the cleaner docking portion;

a suction tube provided in the collection chamber to allow the dust which is guided by the guide portion to be sucked to the collection chamber; and a connection hose formed of a flexible material and configured to connect the guide portion to the suction tube, and arranged on outside of the station housing, the connection hose comprising a first end and a second end detachable from, or attachable and fastened to the guide portion and the suction tube, respectively.

2. The robot cleaner station of claim 1, wherein the first end is a first fastener and the second end is a second fastener, and a suction flow path is formed between the first fastener and the second fastener to allow the dust from the dust collector to be sucked therein.

3. The robot cleaner station of claim 2, wherein the guide portion comprises a communication opening in communication with the suction port, and a first connection hose fastener to which the first fastener is attachable and fastened, and wherein a guide flow path is formed between the communication opening and the first connection hose fastener so as to guide the dust from the dust collector.

4. The robot cleaner station of claim 3, wherein the first connection hose fastener comprises a plurality of first hook fasteners and the first fastener comprises a plurality of first hooks detachable from, and attachable and fastened to the plurality of first hook fasteners, respectively, and a first sealing member configured to seal between the first fastener and the first connection hose fastener.

5. The robot cleaner station of claim 4, further comprising an accessory for manually cleaning the floor and an extension hose configured to increase a length of the connection hose, and the accessory and the extension hose are respectively detachable from, or attachable and fastened to the first fastener when the first fastener is detached from the first connection hose faster of the guide portion.

6. The robot cleaner station of claim 2, wherein the first fastener comprises a protrusion to which a button holder configured to fasten the connection hose and the guide portion is detachable from, or attachable and fastened, wherein the guide portion comprises a communication opening in communication with the suction port, a button holder fastener to which the button holder is detachable from or attachable and fastened, and a guide flow path formed between the communication opening and the button holder fastener so as to guide the dust from the dust collector.

7. The robot cleaner station of claim 6, wherein the button holder comprises a fixing protrusion detachable from, or attachable and fixed to the button holder fastener and a button comprising a hook detachable from, or attachable and fastened to the protrusion, wherein the button holder fastener comprises an insertion groove into which the fixing protrusion is inserted, and a fixing groove to which the fixing protrusion inserted into the insertion groove is rotated and fixed.

8. The robot cleaner station of claim 2, wherein the collection chamber comprises an insertion port into which the suction tube is inserted, and the suction tube comprises an insertion portion inserted into the insertion port and a second connection hose fastener to which the second fastener is detachable from, or attachable and fastened.

9. The robot cleaner station of claim 8, wherein the second connection hose fastener comprises a plurality of second hook fasteners and the second fastener comprises a plurality of second hooks detachable from, or attachable and fastened to the plurality of second hook fasteners, respectively, and a second sealing member configured to seal between the second fastener and the second connection hose fastener.

10. The robot cleaner station of claim 8, wherein the second connection hose fastener comprises a second screw and the second fastener comprises a first screw detachable from, or attachable and fastened to the second screw, and a second sealing member configured to seal between the second fastener and the second connection hose fastener.

11. The robot cleaner station of claim 1, wherein the collection chamber comprises a dust bag accommodated in the collection chamber and in which the dust from the dust collector is collected, wherein the suction tube is connected to the dust bag.

12. The robot cleaner station of claim 3, wherein the first connection hose fastener is extended at about an angle of 90 degrees or more and about 180 degrees or less with respect to the guide flow path.

13. The robot cleaner station of claim 1, wherein the guide portion is extended from inside of the cleaner docking portion to the outside of the station housing so as to be connected to the connection hose.

14. A robot cleaner station comprising:

a cleaner docking portion to which a robot cleaner is docked and comprising an suction port in communication with a dust collector of the robot cleaner when the robot cleaner is docked to the cleaner docking portion;

a collection chamber comprising a dust bag in which dust sucked from the dust collector through the suction port is collected;

a station suction device configured to generate a suction force to suck the dust from the dust collector to the dust bag;

a station housing in which the collection chamber and the station suction device are accommodated; and a connector configured to connect the suction port to the collection chamber, wherein the connector comprises:

a guide portion in communication with the suction port to guide the dust sucked from the dust collector and extended in a horizontal direction in the cleaner docking portion;

a suction tube provided in the collection chamber to allow the dust which is guided by the guide portion to be sucked to the dust bag; and a connection hose formed of a flexible material, arranged on outside of the station housing, and configured to connect the guide portion to the suction tube, and configured to be detachable from, or attachable and fastened to the guide portion when the connection hose is detached from the guide portion, the connection hose is used to suck dust on a floor for manual cleaning.

15. The robot cleaner station of claim 14, wherein the connection hose comprises a first fastener detachable from, or attachable and fastened to the guide portion, a second fastener detachable from, or attachable and fastened to the suction tube, and a suction flow path provided between the first fastener and the second fastener to allow the dust from the dust collector to be sucked therein.

16. The robot cleaner station of claim 14, wherein:

the collection chamber comprises a bag fastener to which the dust bag is detachable from, or attachable and fastened, and the dust bag comprises a chamber fastener detachable from, or attachable and fastened to the bag fastener.

17. The robot cleaner station of claim 16, wherein:

the collection chamber comprises an insertion port into which the suction tube is inserted, wherein the bag fastener and the chamber fastener comprise a first opening and a second opening provided at a position corresponding to the insertion port so as to communicate with the insertion port.

* * * * *